US006796381B2

(12) United States Patent
Ayler et al.

(10) Patent No.: US 6,796,381 B2
(45) Date of Patent: Sep. 28, 2004

(54) APPARATUS FOR EXTRACTION OF OIL VIA UNDERGROUND DRILLING AND PRODUCTION LOCATION

(75) Inventors: Maynard F. Ayler, Golden, CO (US); Richard E. Andrews, Delta, CO (US)

(73) Assignee: Ormexla USA, Inc., Corona del Mar, CA (US)

( * ) Notice: Subject to any disclaimer, the term of this patent is extended or adjusted under 35 U.S.C. 154(b) by 48 days.

(21) Appl. No.: 10/179,799

(22) Filed: Jun. 25, 2002

(65) Prior Publication Data

US 2003/0089506 A1 May 15, 2003

Related U.S. Application Data

(60) Provisional application No. 60/332,869, filed on Nov. 12, 2001.

(51) Int. Cl.[7] ..... E21B 33/128

(52) U.S. Cl. ..... 166/387; 166/88.1

(58) Field of Search ..... 166/387, 368, 166/382, 373, 374, 77.1, 85.4, 86.2, 88.1

(56) References Cited

U.S. PATENT DOCUMENTS

| | | | | |
|---|---|---|---|---|
| 31,677 A | | 3/1861 | Rulofson et al. | |
| 50,903 A | | 11/1865 | Casamajor | |
| 3,656,549 A | * | 4/1972 | Holbert et al. | 166/356 |
| 3,882,640 A | | 5/1975 | Watt | 51/34 |
| 3,965,987 A | | 6/1976 | Biffle | 166/315 |
| 4,099,783 A | | 7/1978 | Verty et al. | 299/2 |
| 4,165,903 A | | 8/1979 | Cobbs | 299/2 |
| 4,307,783 A | * | 12/1981 | Lanmon, II | 166/379 |
| 4,367,794 A | * | 1/1983 | Bednar et al. | 166/66.5 |
| 4,368,920 A | | 1/1983 | Tabakov et al. | 299/2 |
| 4,381,124 A | | 4/1983 | Verty et al. | 299/2 |
| 4,425,055 A | * | 1/1984 | Tiedemann | 405/217 |
| 4,458,945 A | | 7/1984 | Ayler et al. | 299/2 |
| 4,502,733 A | | 3/1985 | Grubb | 299/2 |
| 4,595,239 A | | 6/1986 | Ayler et al. | 299/2 |
| 4,607,888 A | | 8/1986 | Trent et al. | 299/2 |
| 4,886,121 A | * | 12/1989 | Demny et al. | 166/382 |
| 5,020,635 A | | 6/1991 | Lunn | 184/6.18 |
| 5,082,054 A | | 1/1992 | Kiamanesh | 166/248 |
| 5,111,892 A | | 5/1992 | Sinor et al. | 175/65 |
| 5,133,410 A | | 7/1992 | Gadelle et al. | 166/308 |
| 5,593,231 A | | 1/1997 | Ippolito | 384/114 |
| 5,893,417 A | | 4/1999 | Pizzolato | 166/377 |
| 6,142,672 A | | 11/2000 | Bently et al. | 384/118 |

* cited by examiner

*Primary Examiner*—Frank Tsay
(74) *Attorney, Agent, or Firm*—Marsh Fischmann & Breyfogle LLP

(57) ABSTRACT

A well pressure control assembly includes an annular pressure containment structure useful for manipulating pipe during drilling and other well operations performed with annular pressure at the wellhead. The annular pressure containment structure includes a sealing structure involving a sealing wall and a fluid port extending through the sealing wall through with a hydrodynamic bearing fluid is injectable adjacent pipe received in the annular pressure containment structure.

48 Claims, 21 Drawing Sheets

APPARATUS FOR EXTRACTION OF OIL VIA UNDERGROUND DRILLING AND PRODUCTION LOCATION

CROSS-REFERENCE TO RELATED APPLICATIONS

This application claims a priority benefit under 35 U.S.C. Section 119 to prior U.S. Provisional Patent Application No. 60/332,869, filed on Nov. 12, 2001, the entire contents of which are incorporated herein as if set forth herein in full.

FIELD OF THE INVENTION

The invention relates to hydrocarbon production, and in particular, to a pressure control assembly for working pipe in a well under pressure.

BACKGROUND OF THE INVENTION

Conventional petroleum extraction often leaves a significant amount of un-recovered petroleum in petroleum reservoirs. One way to increase recovery is to develop the reservoir with a very high density of producing wells. This option is, however, very expensive and often not economic. One proposal for increasing well density, however, is to drill the producing wells into the reservoir from a subterranean mine excavation located below the petroleum reservoir. Such upward extending wells are often referred to as drain holes, because fluids drain down through the well during production. The economics of drilling wells to a very dense spacing can be more favorable, because each of the producing wells drilled from such a subterranean location will typically be much shorter than wells drilled from a surface location in a conventional manner. This is because the subterranean mine excavation is located much closer to the petroleum reservoir. In addition, expensive drill mud is not needed. Since only water is used to cool the drill bit and there is no backpressure in the drill hole, natural reservoir permeability is not contaminated. Further, drains are produced by gravity, well pumps are not needed. Production through a subterranean mining excavation is potentially an option both for initial development of new reservoirs and for further development of reservoirs that have already been partially depleted by conventional production from production wells drilled from surface locations.

One complication with drilling drain holes and producing petroleum from a subterranean mine excavation located below a petroleum reservoir is that drilling and other well operations must ordinarily be conducted under pressure. Because the drain holes extend in an upward direction, there will always be a positive pressure exerted at the wellhead, which wellhead could be a drilling stack or any other wellhead configuration used for conducting other well operations. This pressure will typically equal the pressure exerted by the reservoir plus the hydrostatic head of fluid filling the drain hole. This is significantly different than conventional operations conducted from a surface location. In the conventional situation, drilling and other well operations are typically conducted without positive pressure at the wellhead, because the well is filled with a liquid that provides a hydrostatic head to counterbalance the reservoir pressure. In the conventional situation, well operations are ordinarily performed under pressure only under upset conditions, such as when there has been a sudden influx of fluid into the wellbore during drilling. As a result, conventional blowout preventers and other conventional wellhead components are typically not designed for normal continuous operation under pressure. These conventional wellhead components are, therefore, typically not well suited for performing drilling or other well operations on drain holes that extend in an upward direction from a subterranean mine excavation, and there is a significant need for improved apparatus and techniques for performing drilling and other operations in such drain holes.

SUMMARY OF THE INVENTION

The present invention addresses the need for performing normal drilling and other well operations under pressure at the wellhead through the use of a special annular sealing structure for sealing the annular space around pipe that is to be manipulated in a well to perform the operation. The sealing structure involves maintenance of a seal between an annular sealing wall and the outside of the pipe in a way that accommodates movement of the pipe under pressure during well operations. In particular, the sealing structure involves a sealing wall with at least one fluid port extending through the sealing wall so that a hydrodynamic bearing fluid is injectable into the annular space between the sealing wall and the outside surface of the pipe. The hydrodynamic bearing fluid helps to maintain a good annular pressure seal while at the same time providing significant lubrication between the sealing wall and the pipe, significantly reducing wear to the sealing wall from manipulation of the pipe during operations performed under pressure.

One aspect of the invention involves a well pressure control assembly. In one embodiment, the well pressure control assembly is operably connectable to a well, typically through a flange connection to well casing, and includes an annular pressure containment structure including the noted sealing structure. The annular pressure containment structure has a passage through which pipe is moved into and out of the well and in which the pipe can be rotated, such as during drilling operations. The annular pressure containment structure includes a sealing wall that defines at least a portion of the passage and includes at least one fluid port extending through the sealing wall adjacent to the passage. When a pipe is received in the passage, hydrodynamic bearing fluid is injectable though the fluid port into the passage adjacent the pipe. In a preferred embodiment, hydrodynamic bearing fluid distributes evenly circumferentially around the pipe so that a liquid film develops between the sealing wall and the pipe, resulting in the development of a hydrodynamic bearing that maintains a standoff between the sealing wall and the pipe.

One alternative for enhancing performance of the annular pressure containment structure is to provide the sealing wall as a flexible wall, such as in the form of a flexible wall of a flexible bladder. The flexible bladder also defines a pressurization cavity within the pressure containment structure that is separated from the passage by the sealing wall. The pressurization cavity is in fluid communication with the passage through the fluid port, so that when the pressurization cavity is pressurized with the hydrodynamic bearing fluid, the hydrodynamic bearing fluid is injected into the passage through the fluid port.

In addition to the annular sealing structure, the annular pressure containment structure is versatile in that any number of different wellhead components can be assembled into the annular pressure containment structure along with the sealing structure to provide various wellhead features for different well operations. For example, the annular pressure containment structure can include components to facilitate circulation of a working fluid and drill cuttings out of the well during drilling operations and for reducing the potential that drill cuttings will detrimentally interfere with operation of the annular sealing structure.

In another aspect, the invention involves a well assembly for drilling or other manipulation of pipe in a well under pressure. In one embodiment, the well assembly includes the annular pressure control assembly operably connected to the well, typically through a flange connection to a casing string, so that the passage through the annular pressure containment structure is aligned with an interior space in the well for communication of pipe through the passage into and out of the well. In one embodiment, the well assembly includes a pipe received in the passage through the annular pressure containment structure, so that the pipe is manipulable under pressure for movement at least translationally into and out of the well and preferably also rotationally about a longitudinal axis of the pipe.

In another aspect, the invention involves a method of manipulating a pipe in a well. In one embodiment, the method includes disposing a distal end of a pipe in a well through the annular pressure containment structure so that a proximal end of the pipe remains outside of the well. The pipe is manipulated while a hydrodynamic bearing fluid is injected adjacent the pipe to help maintain an annular seal around the pipe and to help lubricate between the pipe and the sealing wall. The manipulation of the pipe could include, for example, translating the pipe into or out of the well or rotating the pipe about a longitudinal axis of the pipe, such as would normally occur during drilling operations. In one embodiment, a working fluid is circulated through the interior conduit of the pipe into the well and out of the well through the annular space surrounding the pipe. The circulating fluid, and also drill cuttings in the case of drilling, are removed from the annular pressure containment structure through a fluid port in fluid communication with an annular space in the annular pressure containment structure that is located between the sealing wall and the well. In one embodiment, at least a portion of the hydrodynamic bearing fluid is directed into the annular space to mix with the working fluid and to be withdrawn from the annular pressure containment structure along with at least a portion of the working fluid.

After producing hydrocarbon fluids from wells drilling and/or otherwise manipulated with the present invention, the produced hydrocarbon fluids could be subjected to downstream processing to prepare an upgraded hydrocarbon product. In another aspect, the invention involves a method for preparing such an upgraded hydrocarbon fluid product. In one embodiment, the method includes drilling a well into a hydrocarbon-bearing subterranean formation and extracting a hydrocarbon fluid from the subterranean formation through the well. The drilling step includes at least drilling with a drill bit connected to a distal end of a pipe extending through the passage of the annular pressure containment structure and into the wellbore. The method according to this aspect of the invention could also include among other things the step of refining the hydrocarbon fluid to produce a refined hydrocarbon product.

In another aspect, the present invention involves an assembly and method useful for drilling an anchor hole for a well from a subterranean excavation. In one embodiment, the assembly comprises an annular pressure containment structure fastened to a surface of the subterranean excavation by rock bolts. In the situation where the well is to be drilled in an upward direction, the assembly would be fastened to a portion of the roof of the subterranean excavation, while the assembly would be fastened to a portion of the floor for a well to extend down from the subterranean excavation. The annular pressure containment structure includes an interior passage adapted for receiving a pipe that is rotatable to drill the anchor hole, a fluid port in fluid communication with the passage through which drill cuttings are removable from the passage during the drilling, and a shield located between the surface of the subterranean excavation and the fluid port for directing the drill cuttings to the fluid port. In one embodiment of the method, the assembly is used to drill the anchor hole through rotation of the pipe extending through the annular pressure containment structure with a bit attached to the distal end of the pipe to dislodge pieces of rock as drill cuttings, which drill cuttings are then removable through the fluid port. To cool the bit and to assist removal of cuttings through the fluid port, a working fluid can be circulated through the interior flow conduit of the pipe and the drill bit, into the passage in the annular pressure control assembly and ultimately out through the fluid port. The working fluid could be a liquid, such as an aqueous liquid, or could be a gas, such as air.

In another aspect the present invention involves an assembly and method for securing casing pipe, such as for example securing anchor casing to support drilling of a well at an upward angle from a subterranean excavation. In one embodiment, the assembly includes a cementing unit connected to the proximal end of the casing pipe to be cemented. In this embodiment, the cementing unit comprises an interior volume in fluid communication with an interior space of the casing pipe, a plunger movable within the interior volume of the cementing unit and into the interior space of the casing pipe, and a fluid port in fluid communication with the interior volume of the cementing unit and through which cement is introducible into the interior volume between the plunger and the interior space of the casing pipe. According to one embodiment of the method, the plunger is moved from the interior volume of the cementing unit into the interior space inside the casing pipe to force at least a portion of the cement out of the distal end of the casing pipe and around the outside of at least a portion of the casing pipe disposed in the hole.

In another aspect, the present invention involves an assembly and a method for perforating a well, such as for example a well drilled at an upward angle from a subterranean excavation. In one embodiment, the assembly includes a pipe longitudinally extending from a proximal end located outside of the well to a distal end located in the well, with the pipe having an interior conduit for directing the flow of fluid through the pipe between the distal end and the proximal end, with a seal across the interior conduit at some location between the distal end and the proximal end that prevents the flow of fluid from the distal to the proximal end of the pipe. In this embodiment, a perforating unit is connected to the proximal end of the pipe, with the perforating unit containing a propellant and at least one projectile, wherein the perforating unit is actuatable to ignite the propellant, causing the projectile to be propelled in the direction of the seal to puncture a hole through the seal to permit the flow of fluid through the interior conduit from the distal end of the pipe to the proximal end. In one embodiment of the method, the perforating unit is actuated to perforate one or more hole through the seal, thereby permitting fluids from a hydrocarbon-bearing formation to flow through the interior conduit of the pipe to be produced from the well.

In another aspect, the present invention involves an assembly and a method concerning securing pipe in a wellhead of a well that extends upward from a subterranean excavation so that the pipe in the well is in compression rather than in tension as is the case with conventional wells that extend downward from a surface location. In one embodiment, the assembly includes a wellhead assembly connected to a casing pipe extending at least some distance into a well, with the wellhead assembly including a plurality of collets that can be wedged against pipe that extends from the wellhead assembly through an interior space of the casing pipe in the well. When wedged against the pipe, the collets secure the pipe in place, with the pipe being in compression, because the distal end of the pipe in the well will be at a vertically higher location than the portion of the pipe secured by the collets. In one embodiment of the method, the distal end of the pipe to be secured is translated through a wellhead assembly and into a well to which the wellhead assembly is connected, with a proximal end of the pipe not passing through the wellhead assembly and remaining outside of the wellhead assembly with the proximal end of the pipe being located vertically lower than the distal end of the pipe. In this embodiment, the collets are then wedged around the outside of a portion of the pipe disposed in the wellhead assembly to secure the pipe.

In another aspect, the present invention involves a method for recovering hydrocarbon fluid from a subterranean hydrocarbon-bearing formation, such as in a petroleum or gas reservoir, through a well extending in an upward direction into the formation from a subterranean excavation located below the formation. In one embodiment, the method involves draining hydrocarbon fluid from the well through a production pipe extending into the well while simultaneously injecting water into the formation through the annular space in the well outside of the production pipe. In a preferred situation, the production pipe extends upward above a hydrocarbon fluid-water contact (e.g., oil-water contact or gas-water contact) in the formation, with the hydrocarbon fluids being drained from the formation above the contact and the water being injected into the formation below the contact. In one embodiment, at least a portion of the water is recycled water produced from the formation along with hydrocarbon fluid, with the produced fluid being transported to the surface for separation of the water followed be piping at least a portion of the water back into the subterranean excavation for injection into the well.

In another aspect, the present invention involves a bit retainer for use in drilling operations for drilling a well in an upward direction. In one embodiment, the bit retainer includes a space into which a bit is retractable. The shape of the retraction space is keyed to correspond with the shape of the bit, so that the bit retainer and the bit cannot rotate relative to each other when the bit is retracted into the retraction space of the bit retainer. This permits the pipe to be threaded onto and unthreaded from the pipe without removing the bit from the annular pressure containment structure of the present invention.

In another aspect, the present invention involves an assembly useful for producing hydrocarbon fluids from wells drilled in an upward direction from a subterranean excavation. The assembly permits the wells to be connected to a closed collection system in the subterranean excavation. The collected hydrocarbon fluids, and any accompanying produced water, can then be transferred to the surface for storage and/or treating.

DETAILED DESCRIPTION

Figure 1:
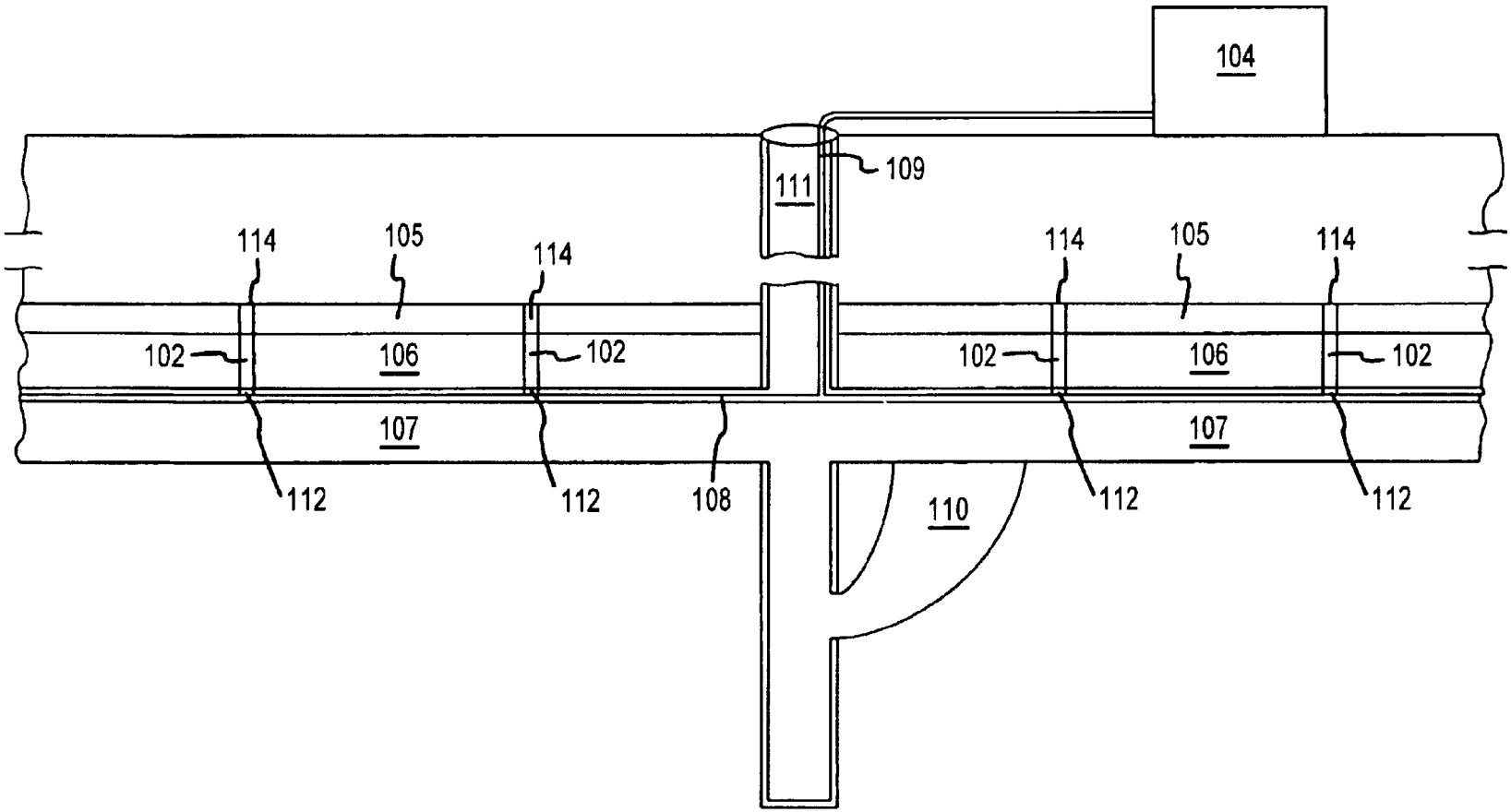
FIG. 1 is a schematic showing one system for developing a hydrocarbon-bearing reservoir with wells drilled upward into the reservoir from a subterranean mine excavation located below the reservoir.

According to one aspect, the invention provides a well pressure control assembly for use in working pipe in a well under pressure. The pressure control assembly includes an annular pressure containment structure with a passage extending through the annular pressure containment structure that is configured to receive the pipe for communication of the pipe through the passage into and out of the well under pressure and to accommodate rotation of the pipe about a longitudinal axis of the pipe. Defining at least a portion of the passage is a sealing wall against which a pressure seal can be maintained between pipe received in the passage and the sealing wall to retain annular pressure that may be exerted at the surface during various well operations. The seal is maintained by injection of a hydrodynamic bearing fluid into the passage between the pipe and the sealing wall through at least one fluid port extending through the sealing wall and being in fluid communication with the passage. The injected hydrodynamic bearing fluid provides a dual benefit of assisting to maintain the seal and providing lubrication between the pipe and the sealing wall. The hydrodynamic bearing fluid could be any suitable fluid for providing the sealing and lubricating function, but is typically a substantially incompressible liquid. Particularly advantageous for use as the hydrodynamic bearing fluid is water.

The well pressure control assembly of the present invention is useful for performing operations involving working pipe in the well under pressure. For instance, the present invention is particularly useful for moving pipe into and out of a well under pressure and for drilling operations conducted with positive annular pressure exerted at the drilling stack. This situation is normal when drilling a well at an upward angle, such as upward into a hydrocarbon-bearing reservoir from a subterraneous drilling location located below the reservoir, because the hydrostatic head of the working fluid, which can be referred to as the drill fluid in a drilling operation, is exerted at the drilling stack. This is in sharp contrast to conventional drilling operations conducted from a surface location above a reservoir, in which case the normal practice is for the drill fluid to be sufficiently dense so that the hydrostatic head of the drill fluid is greater than pressure exerted by the reservoir, so that there is no positive pressure that is communicated from subterranean strata to the drilling stack. It should be recognized, however, that although the well pressure control assembly of the present invention has been designed specifically to address the situation of a well extending upward into a hydrocarbon-bearing reservoir from below, the well pressure control assembly is also useful in situations where the well extends in a downward direction into a hydrocarbon-bearing reservoir from above, as is the case with conventional drilling and production operations. Moreover, the present invention is also useful for drilling wells in a downward direction from a subterranean mine excavation into a hydrocarbon reservoir located below the subterranean excavation. In one embodiment of the invention, the subterranean excavation is located vertically between different hydrocarbon zones and wells are drilled both in an upward direction into a formation located above the subterranean excavation and in a downward direction into a formation located below the subterranean excavation.

Referring now to FIG. 1, a general schematic is shown of one example for extraction of hydrocarbon fluids via a subterranean mine excavation. As shown in FIG. 1, a plurality of wells 102 extend from a subterranean mine excavation 107 in an upward direction into a hydrocarbon-bearing zone 105. The subterranean mine excavation 107 is accessible from the surface 110 though a shaft 111 having a steel or concrete lining. A shaft pocket 110 provides a space for waste rock storage. The subterranean mine excavation 107 shown in the form of an access tunnel is separated from the hydrocarbon-bearing zone 105 by a layer of fluid impermeable rock 106. The shaft 111 is of sufficiently large diameter to permit conveyance of necessary equipment and personnel into the subterranean mine excavation 107 as necessary to conduct well drilling, production and maintenance operations. Each of the wells 102 is connected to production collection piping 108 through which fluids produced from the wells 102 are collected and pumped to a surface storage tank 104 via a production line 109.

Each of the wells 102 has a wellhead inside the subterranean mine excavation 107 operatively connected to a proximal end of the well. A distal end 114 of each well is at a vertically higher location than the proximal end 112. By "proximal" end of a well, it is meant the end from which produced hydrocarbon fluids are withdrawn from the well. Conversely, the "distal" end of a well is the end of the well longitudinally opposite the proximal end. The proximal end is the end through which pipe is inserted into the well to perform well operations.

In a preferred embodiment of the pressure containment structure, the sealing wall is part of a sealing unit that is assemblable with other drilling stack and/or other wellhead components to provide desired features for a particular operation. Therefore, the sealing unit will typically have flange or other connecting structures to facilitate easy assemblage with other components. The connections between components can be sealed using any desired sealing structures. Examples include gasket seals and o-ring seals.

Figure 2:
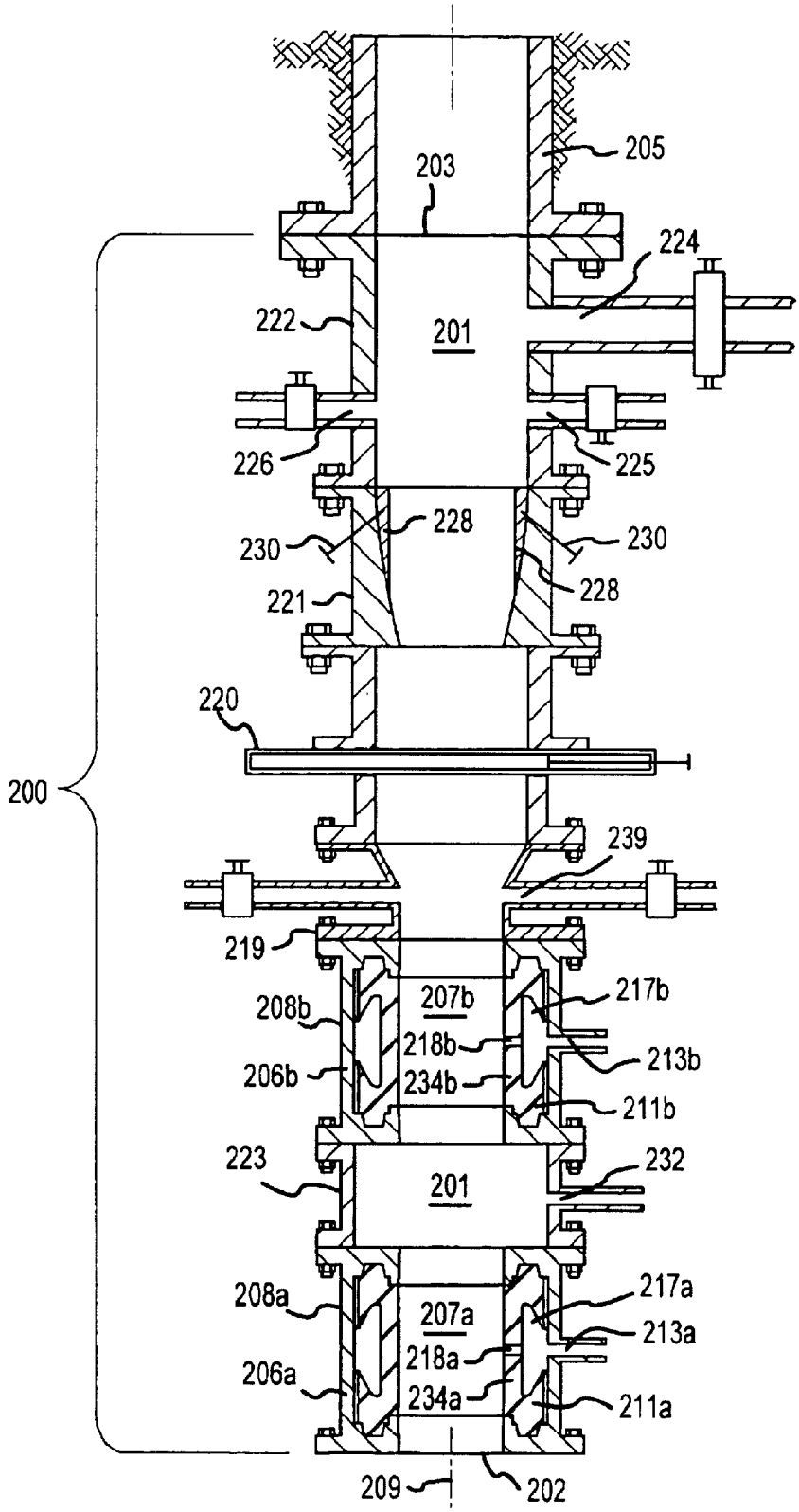
FIG. 2 is a sectional view showing one embodiment of the annular pressure containment structure operably connected to a well and useful in drilling operations.

Referring now to FIG. 2, one example of an annular pressure containment structure 200 sealably connected through a flange connection to a casing pipe 205 of a well. The casing pipe could be, for example, an anchor casing or some other casing string providing access into to the well. For illustration purposes, the well is shown extending in an upward direction, as would be the case, for example, for the wells 102 shown in FIG. 1. It should be appreciated, however, that the same principles apply for use of the annular pressure containment structure 200 with a well having a different orientation, such as a conventional well extending at a downward angle from a surface location, when a well operation is to be performed under pressure.

As shown in FIG. 2, the annular pressure containment structure 200 is comprised of a number of assembled units connected together through flange connections. The annular pressure containment structure 200 extends in a longitudinal direction from a proximal end 202 to a distal end 203. When the annular pressure containment structure is operably connected with a well (as shown in FIG. 2) the proximal end 202 is located away from the well and the distal end 203 located adjacent to the well. As shown in FIG. 2, a passage 201 extends in a longitudinal direction through the interior of the annular pressure containment structure 200 from the proximal end 202 to the distal end 203. The passage 201 is aligned with the interior space of the well (e.g., the interior space of the casing pipe 205). The passage 201 is therefore adapted to receive pipe for communication of the pipe through the passage 201 into and out of the well 205.

As shown in FIG. 2, the annular pressure containment structure 200 includes two annular pressure sealing units 208*a,b*. Each sealing unit 208*a,b* includes a sealing wall 234*a,b*, which each define a sealing portion 207*a,b* of the passage 201 within the respective sealing units 208*a,b*.

Extending through each sealing wall 234*a,b* is a fluid port 218*a,b* through which hydrodynamic bearing fluid is injectable into the corresponding sealing portion 207*a,b* of the passage 201 within each sealing unit 208*a,b*. Each sealing portion 207 of the passage 201 has a circular cross-section taken in a plane perpendicular to the longitudinal axis 209 of the passage 201. Although only one fluid port 218 is shown for each sending unit 208 it should be understood that a plurality of fluid ports 218 could penetrate each sealing wall 234 with the plurality of fluid ports 218 being circumferentially spaced around the sealing portion 207 of the passage 201 for more even distribution of hydrodynamic fluid injected into the sealing portion 207 of the passage 201.

In the annular pressure containment structure shown in FIG. 2, each sealing wall 234*a,b* is part of an injection piece 211*a,b* having an internal pressurization cavity 217*a,b* in fluid communication with the corresponding fluid port 218*a,b*. Each injection piece 217, therefore, has a doughnut-like shape, with the sealing wall 234 defining the hole in the doughnut and the sealing portion 207 of the pressurization cavity 217 being separated from the sealing portion 207 of the passage 201 by the corresponding sealing wall 234. Each injection piece 211 extends circumferentially entirely round the corresponding sealing portion 207 of the passage 201 in a plane perpendicular to the longitudinal axis 209 of the passage 201.

The sealing wall 234 could be made from any suitable material. For enhanced performance the sealing wall 234 is flexible. In particular, desired flexibility can be imparted to the sealing wall 234 when the injection piece 211 is in the form of a flexible bladder.

As shown in FIG. 2, each sealing unit 208*a,b* has a substantially tubular housing section 206*a,b* in which the corresponding injection piece 211*a,b* is housed. Extending through each housing section 206*a,b* is a fluid port 213*a,b* in fluid communication with the corresponding pressurization cavity 217*a,b*. During operation, hydrodynamic bearing fluid is introducible into each pressurization cavity 217 through the corresponding fluid port 213, thereby pressurizing the corresponding pressurization cavity 217 with hydrodynamic fluid. Some of the hydrodynamic fluid flows from the pressurization cavity 217 through the corresponding fluid port 218 to be injected into corresponding sealing portion 207 of the passage 201.

In the embodiment shown in FIG. 2, the annular pressure containment structure 200 is designed for drilling operations and includes components in addition to the sealing units 208 useful for drilling operations. As shown in FIG. 2, the annular pressure containment structure 200 also includes a bit retainer unit 219, a gate valve 220, a collet unit 221, an annular fluid manipulation unit 222 and a sealing unit spacer 223.

The gate valve 220 permits complete blockage and sealing of the passage 201 between the sealing unit 208*b* and the well, to completely shut-in the well. As will be appreciated, for the gate valve 220 to be closed, the portion of the passage 201 in the gate valve 220 must be free of pipe. The gate valve 220 permits the well to be shut-in, such as for removal of the sealing units 217 when not needed, as would be the case when the well is in a producing rather than a drilling mode.

The collet unit 221 includes a plurality of collets 228 and retaining screws 230 corresponding with each collet 228. In FIG. 2, the collets 228 are shown in a retracted position held by the retaining screws 230, so that pipe can be moved through the passage 201 without interference from the collets 228. The retaining screws 230 can be loosened to permit the collets 228 to drop into place for securing pipe in place, such as for securing a string of production pipe inserted into the well during producing operations. The retaining screws 230 should not, however, be completely removed.

The fluid manipulation unit 222 permits fluids to be introduced into and/or removed from the passage 201 between the sealing unit 208*b* and the distal end 203 of the annular pressure containment structure 200. The fluid manipulation unit 222 includes three fluid ports 224, 225 and 226, each in fluid communication with the passage 201. The fluid ports 224, 225 and 226 permit fluids to be introduced into or removed from the passage 201. For example, during drilling operations, the fluid port 224 would be used as a fluid discharge line for removing working fluid and cuttings that are circulated out of the well. Fluid ports 225 and 226 provide additional access into the annular fluid manipulation unit 222 to provide additional flexibility for introducing fluids into or removing fluids from the fluid manipulation unit 222 as desired for any particular operation. The bit retainer unit 219 includes two fluid ports 239 and 240. During drilling operations, a flush fluid, typically aqueous liquid, can be introduced into the passage 201 through one or both of the fluid ports 239 and 240 to flush cuttings away from the sealing unit 208*b* to prevent the cuttings from contacting and possible damaging the sealing wall 234*b*. Alternatively, the flush fluid can be introduced into one of the fluid ports 239 and 240 and removed along with small quantities of working fluid and cuttings through the other one of the fluid ports 239 and 240.

The sealing unit spacer 223 is located between the two sealing units 208*a,b* and includes a fluid port 232. The fluid port 232 permits removal of small amounts of hydrodynamic bearing fluid that is directed into the passage 201 in the sealing unit spacer 223 when hydrodynamic bearing fluid is injected through the fluid ports 218*a,b* in the sealing units 208*a,b*.

It should be appreciated that the embodiment shown in FIG. 2 is only one possibility for the annular pressure containment structure of the present invention, and that the annular pressure containment structure could include various other combinations of elements to provide features other than or in addition to those described with reference to FIG. 2 to accommodate requirements for any particular well operation. For example, the annular pressure containment structure used for drilling operations could be configured to include standard blowout preventers in addition to one or more sealing units.

Figure 3:
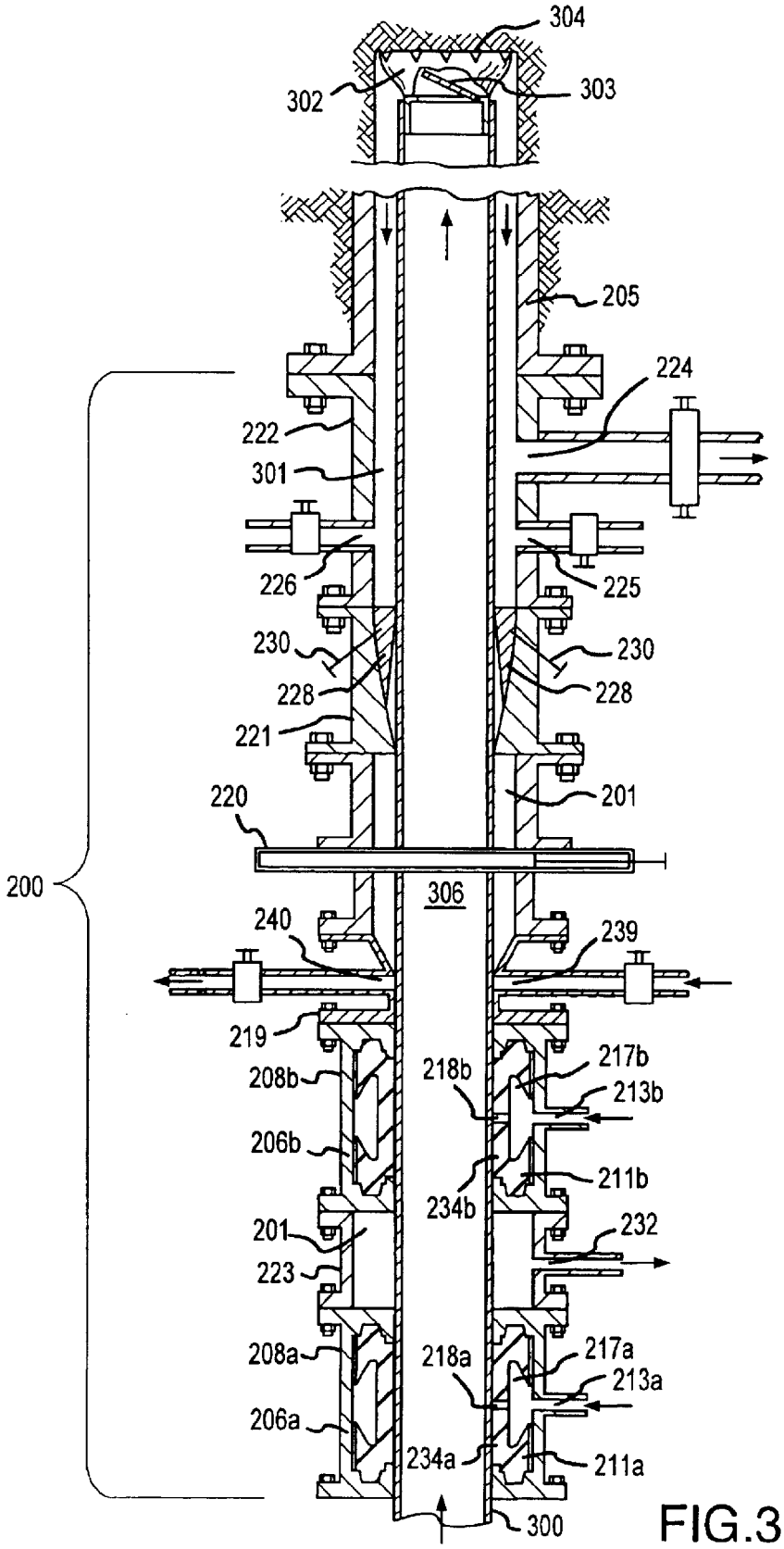
FIG. 3 is a sectional view showing the annular pressure containment structure of FIG. 2 having a pipe received in the passage through the annular pressure containment structure for communication of the pipe into the well.

As noted, the well pressure control assembly of the present invention is useful for manipulating pipe under pressure. In particular, the well pressure control assembly is useful for controlling pressure in an annular space surrounding a working pipe. Referring now to FIG. 3, the annular pressure containment structure 200 of FIG. 2 is shown having a pipe 300 received in the passage 201. The pipe 300 extends in a longitudinal direction through the passage 201 and into the interior space of the well. At a distal end of the pipe 300 is attached a drill bit 302, such as would be used during drilling operations. An annular space 301 in the passage 201 around the outside of the pipe in the annular pressure containment structure 200 is in fluid communication with the annular space in the well. The annular pressure containment structure 200 can be made of a size to accommodate any desired diameter of pipe. Typically, the pipe 300 will have an outside diameter of at least about 2.5 centimeters (1 inch) and more typically within a range of from about 2.5 centimeters (1 inch) to about 15.2 centimeters (6 inches). Commonly, the pipe 300 will have an outside diameter in a range of from about 7.6 centimeters (3 inches) to about 15.2 centimeters (6 inches). Also, for drilling operations, the pipe 300 will typically be a string of pipe pieces joined together through flush joint connections, meaning that the outside diameter of the string of the pipe 300 has a constant outside diameter, and is not enlarged where pieces of pipe are coupled.

With reference to FIGS. 2 and 3, operation of the pressure control assembly including the annular pressure containment structure 200 will now be described. During drilling, the pipe 300 is rotated about a longitudinal axis of the pipe 300 to rotate the drill bit 302, which is in contact with the distal end 304 of the deepening well. Simultaneous with rotation of the pipe 300, a longitudinally directed force is applied to the pipe 300 so that the drill bit 302 bears against the distal end 304 of the well. As the drill bit 302 removes rock at the distal end 304 of the well, the well is deepened and the pipe 300 translates deeper into the well. A check valve 303 prevents fluids in the well from entering into the interior volume of the pipe 300. The check valve is shown as having a flapper design, but could be any suitable design, such as a ball-and-seat design.

During the drilling, a working fluid (e.g., water or air) is circulated through the interior conduit of the pipe 300 out of the drill bit 302 into the well and out of the well through the annular space in the well surrounding the pipe 300 to the annular space 301 in the annular pressure containment structure 200. The working fluid is then removed from the annular space 301 via the fluid port 224. Fluid ports 225 and 226 will generally be closed to fluid flow at this time. Drill cuttings (pieces of rock dislodged from the distal end 304 of the well) are circulated out of the well by the circulating working fluid and also exit the annular space 301 through the fluid port 224. The arrows shown in FIG. 3 generally show the direction of fluid flow during drilling. Depending upon the particular situation, the working fluid can be a gas, such as in the case of pneumatic drilling, or can be a liquid. When a gas, the working fluid will typically be air. When a liquid, the working fluid will typically be water.

An annular seal is effected around the pipe 300 in the annular pressure containment structure 200 by the annular sealing units 208*a,b*. Hydrodynamic bearing fluid is introduced into the pressurization cavities 217*a,b* through the fluid ports 213*a,b*, with hydrodynamic bearing fluid in turn being injected into the sealing portions 207*a,b* (as shown in FIG. 2) of the passage 201 adjacent the outside surface of the pipe 300. The hydrodynamic bearing fluid is typically an aqueous liquid, such as process water, that will be readily miscible with the working fluid circulating through the well when the working fluid is also an aqueous liquid.

The hydrodynamic bearing fluid helps to maintain a an annular pressure seal between the sealing walls 234*a,b* and the outside surface of the pipe 300 to contain pressure within the annular space 301. Also, the hydrodynamic bearing fluid lubricates between the outside of the pipe 300 and the sealing walls 234*a,b* to reduce wear to the sealing walls 234*a,b*. In a preferred operation, sufficient hydrodynamic bearing fluid is injected and the hydrodynamic bearing fluid is evenly enough distributed circumferentially around the outside surface of the pipe 300 so that a hydrodynamic bearing develops between the sealing walls 234*a,b* and the outside surface of the pipe. By hydrodynamic bearing, it is meant a film of the hydrodynamic bearing fluid around the outside surface of the pipe 300 that maintains a small standoff between the outside surface of the pipe 300 and each of the sealing walls 234*a,b*. During drilling, even distribution of the hydrodynamic bearing fluid circumferentially around the outside of the pipe 300 is aided by the rotation of the pipe 300.

The pressure of the hydrodynamic bearing fluid in the pressurization cavities 217*a,b* will be higher, and preferably only slightly higher, than the pressure in the annular space 301, so that the hydrodynamic bearing fluid will flow through the fluid ports 234*a,b* into the passage 201. The hydrodynamic bearing fluid injected into the passage 201 through the fluid port 234*b* will ultimately flow either into the annular space 301, to mix with the working fluid and exit through fluid port 224, or into the sealing unit spacer 223, to be removed through fluid port 232. The working fluid injected through the fluid port 234*a* will ultimately flow either into the sealing unit spacer 223, to be removed through fluid port 232, or out the proximal end (opposite the sealing unit spacer 223) of the sealing unit 208*a*, where the hydrodynamic bearing fluid can be collected. Under proper operation, very little hydrodynamic bearing fluid should exit the proximal end of the sealing unit 208*a*.

The clearance between the sealing walls 234*a,b* and the outside surface of the pipe 300 should generally be as small as possible, while still maintaining the desired hydrodynamic bearing. The minimum diameter of the passage 201 within the sealing portions 207*a,b* available for pipe access through the sealing units 208*a,b* will be slightly larger than the outside diameter of the pipe 300. In most situations, the minimum diameter within the sealing portions 207*a,b* of the passage 201 will be in the range of from about 2.5 centimeters (1 inch) to about 15.2 centimeters (6 inches). When the injection pieces 211*a,b* are flexible bladders, with the sealing walls 234*a,b* being flexible, the passage diameter through the sealing portions 207*a,b* will be smaller when the sealing units 208*a,b* are actuated, because pressurization of the internal cavities 217*a,b* will cause deflection of the sealing walls 234*a,b* by some amount in the direction of the passage 201. The minimum diameter of the passage 201 through the sealing portions 205*a,b* will typically be no more than a few millimeters larger, and preferably no more than one millimeter larger than the outside diameter of pipe disposed in the sealing units 208*a,b* when the sealing units 208*a,b* are actuated.

To help protect the sealing units 208*a,b*, and particularly the sealing surfaces 234*a,b*, from being damaged during drilling operations, a flush fluid is introduced into the annular space 301 through one or both of the fluid ports 239 and 240. The flush fluid can mix with hydrodynamic bearing fluid from the sealing unit 208*b* and exit the annular space 301 through fluid part 224 with the working fluid that is circulating out of the well. Also, one of fluid parts 239 and 240 can be used to introduce the flush fluid and the other of the fluid parts 239 and 240 can be used to withdraw the majority of the flush fluid along with any cuttings and working fluid not removed through fluid port 224. When the working fluid circulating in the well is air, the flush fluid will also be air. When the working fluid is a liquid, then the flush fluid should also be a liquid that preferably is miscible with the working fluid. For example, the working fluid and the flush fluid will often each be water.

Also, As shown FIGS. 2 and 3, the bit retainer unit 219 includes a flared internal space into which the bit 304 can be retracted when the bit is being inserted into or removed from the annular pressure containment structure. When the bit 304 is retracted into the bit retainer unit 219, the gate valve 220 can be closed and the bit retainer unit 219 can be disconnected from the gate vale 220 to permit the bit 304 to be removed. Likewise, to insert the bit into the annular pressure containment structure 200, the bit 304 is placed in the bit retainer unit 219, which can then be connected to the gate valve 220 when the gate valve 220 is closed. The gate valve 220 can then be opened to permit the bit 304 to be moved into the well. In an important enhancement of the bit retainer unit 219, the flared portion of the bit retainer unit 219 is shaped so as to be keyed to the shape of the bit 304, so that when the bit 304 is retracted into the bit retainer unit, the bit cannot rotate. This keying is similar to the way a nut is held in a wrench, to prevent rotation of the nut relative to the wrench. This keying feature is advantageous, because it permits the pipe 300 to be threaded onto and off of the bit 304 by rotating the pipe 300 in the appropriate direction when the bit 304 is held in the bit retainer unit 304. This system permits an operator to call for changing the drill bit and replacing the bit with a new one.

Figure 4:
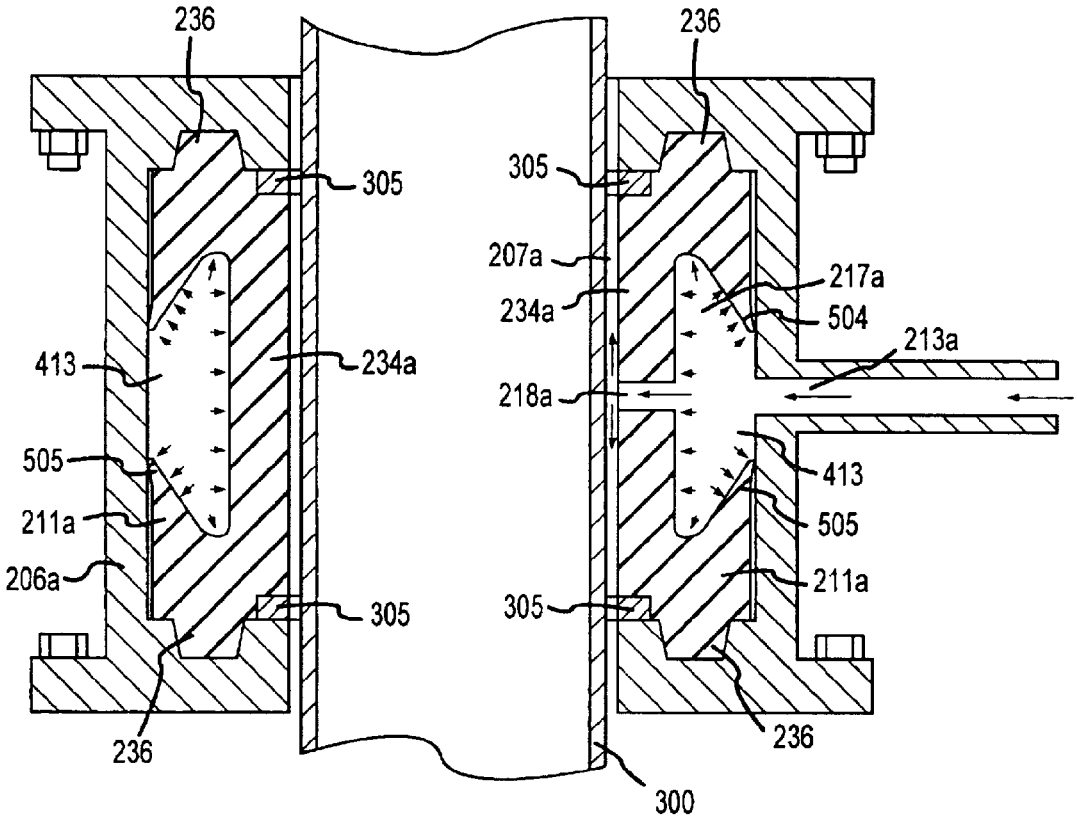
FIG. 4 is a sectional view of one embodiment of an annular pressure sealing unit used in the annular pressure containment structure shown in FIGS. 2 and 3.

As noted previously, a preferred design for the injection pieces 211*a,b* is a flexible bladder, with the sealing walls 234*a,b* each being flexible. Referring now to FIG. 4, and also to FIGS. 2 and 3 as needed, an enlarged view of the sealing unit 208*a* of the annular pressure containment structure shown in FIGS. 2 and 3 is shown having the pipe 300 received in the sealing portion 207*a* of the passage 201. As shown in FIG. 4, the injection piece 211*a* is disposed in the housing section 206*a*. The housing section 206*a* is configured on the inside to retain the injection piece 211*a*. Also as shown in FIG. 4, the sealing unit includes two retaining rings 305. The retaining rings 305 help retain the injection piece 211*a* when the sealing unit sealing unit 208*a* is actuated. The inside diameter of the sealing rings 305 will typically be approximately the same as the inside diameter of the passage through the injection piece 211*a* when the injection piece is in a relaxed position (i.e., when the sealing unit 208*a* is not actuated by pressurization of the pressurization cavity 217*a*).

Figure 5A:
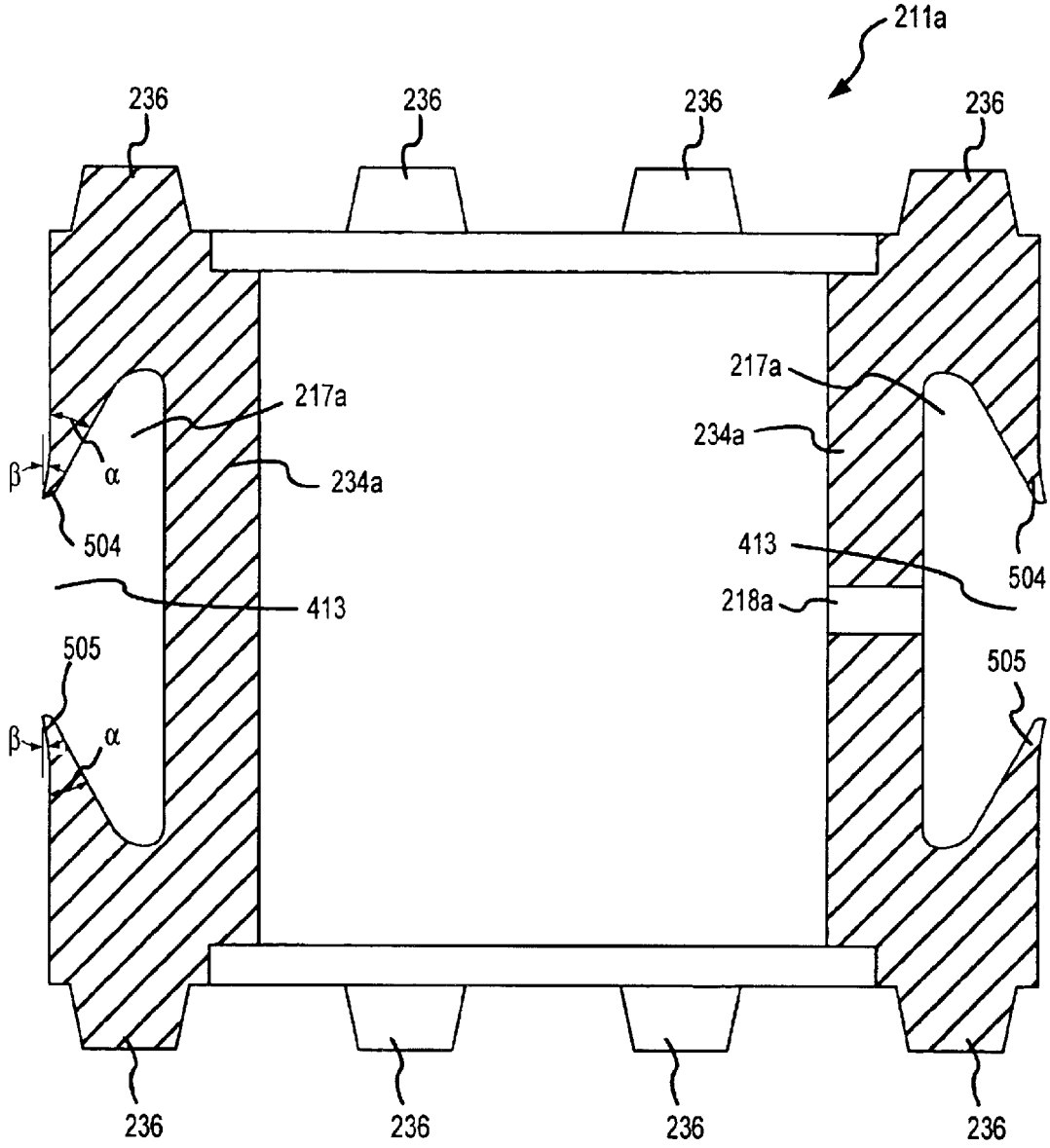
FIG. 5A is a sectional view of one embodiment of an injection piece having a flexible bladder design for use in the sealing unit of FIG. 4.
Figure 5B:
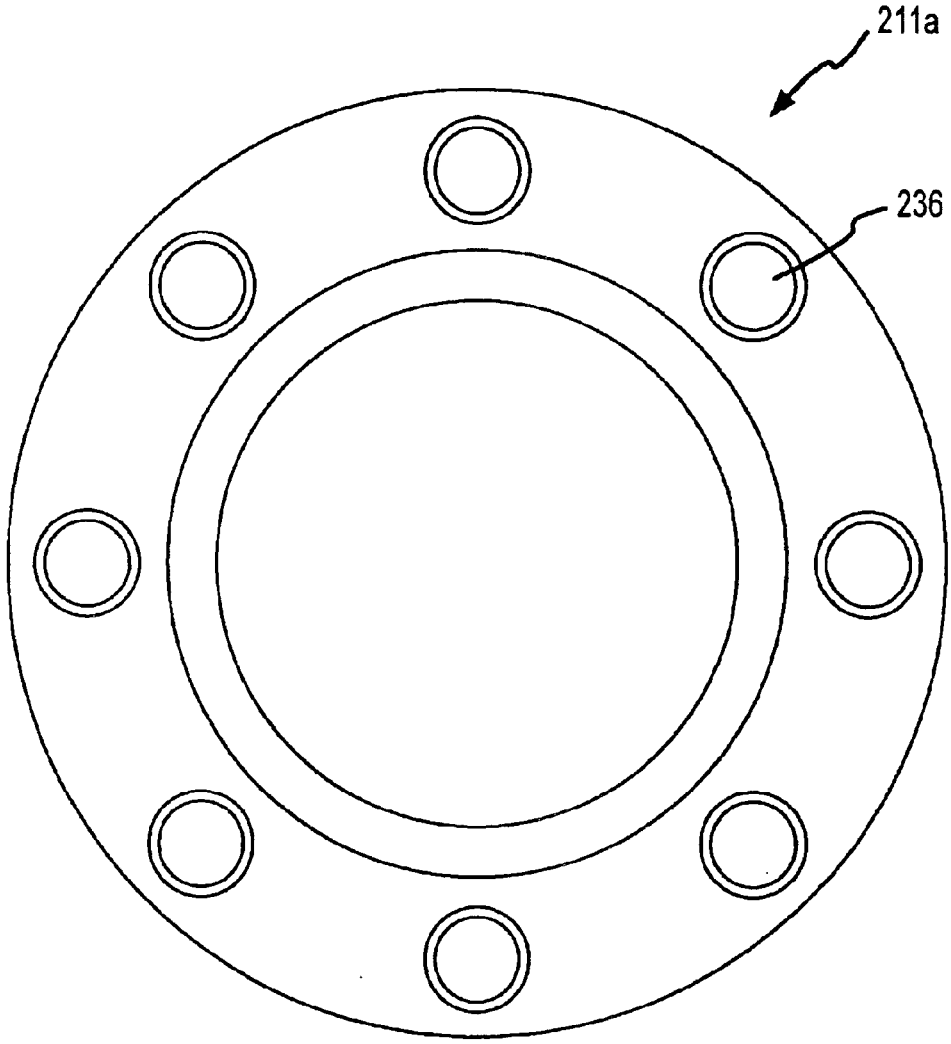
FIG. 5B is a top view of the embodiment of the injection piece shown in FIG. 5A.

FIG. 5A and FIG. 5B show the injection piece 211*a* as it would appear alone, outside of the sealing unit 208*a*. The injection piece 211*a*, as shown in FIGS. 4, 5A and 5B, includes projections 236 that are received in corresponding recesses in the housing section 206*a*. The projections 236 are adapted to mate with the corresponding recesses and thereby retain the injection piece 211*a*. In the embodiment shown in FIG. 4, the projections 236 are each round-shaped projections that fit into the correspondingly round-shaped recesses. In the embodiment of the injection piece 217*a* shown in FIGS. 4 and 5, there are eight equally spaced projections 236 at each end of the injection structure 211*a* (16 total projections) that correspond to eight equally spaced recesses at each end of the housing section 206*a* (16 total recesses).

The injection piece 211*a* includes an opening 413 extending circumferentially entirely around the perimeter of the injection piece 211*a*. The opening 413 is in fluid communication with the pressurization cavity 217*a* and the fluid port 213*a*, so that hydrodynamic bearing fluid is introducible into the pressurization cavity 217*a* through the fluid port 213*a* to pressurize the pressurization cavity 217*a* and cause hydrodynamic bearing fluid to flow through the fluid port 218*a*.

The injection piece 211*a*, as noted previously, is preferably a flexible bladder design. Referring to FIGS. 4 and 5, features of one embodiment of such as rubber bladder design for the injection piece 211*a* is shown. The injection piece 211*a* is made of a flexible material, preferably a rubber material, which may be a natural or synthetic rubber. Particularly preferred materials of construction for the injection piece 211*a* are elastomeric materials, such as, for example, neoprene.

As shown in FIG. 5A, the injection piece 211*a* includes tapered lip portions 504 and 505 adjacent the opening 413. Furthermore, the outer surfaces of the lip portions 504 and 505 indent slightly, with the indentation from the end being at an angle β, as shown in FIG. 5A, that is preferably from about 2° to about 5° when the injection piece 211*a* is not in a restrained situation. When the injection piece 211*a* (as shown in FIG. 4) is in a restrained situation and received in the housing section 206*a*, the lip portions 504 and 505 bear against the inside surface of the housing section 206*a* so that the lip portions 504 and 505 are at least slightly deflected in a direction into the pressurization cavity 217*a*. In operation, these lip portions 504 and 505 help to maintain a good pressure seal between the pressurization cavity 217*a* and the housing section 206*a* of the sealing unit 208*a* when the pressurization cavity 217*a* is pressurized with a hydrodynamic bearing fluid. The angle β is an important aspect of maintaining a good pressure seal between the pressurization cavity 217*a* and the housing section 206*a*.

Figure 16:
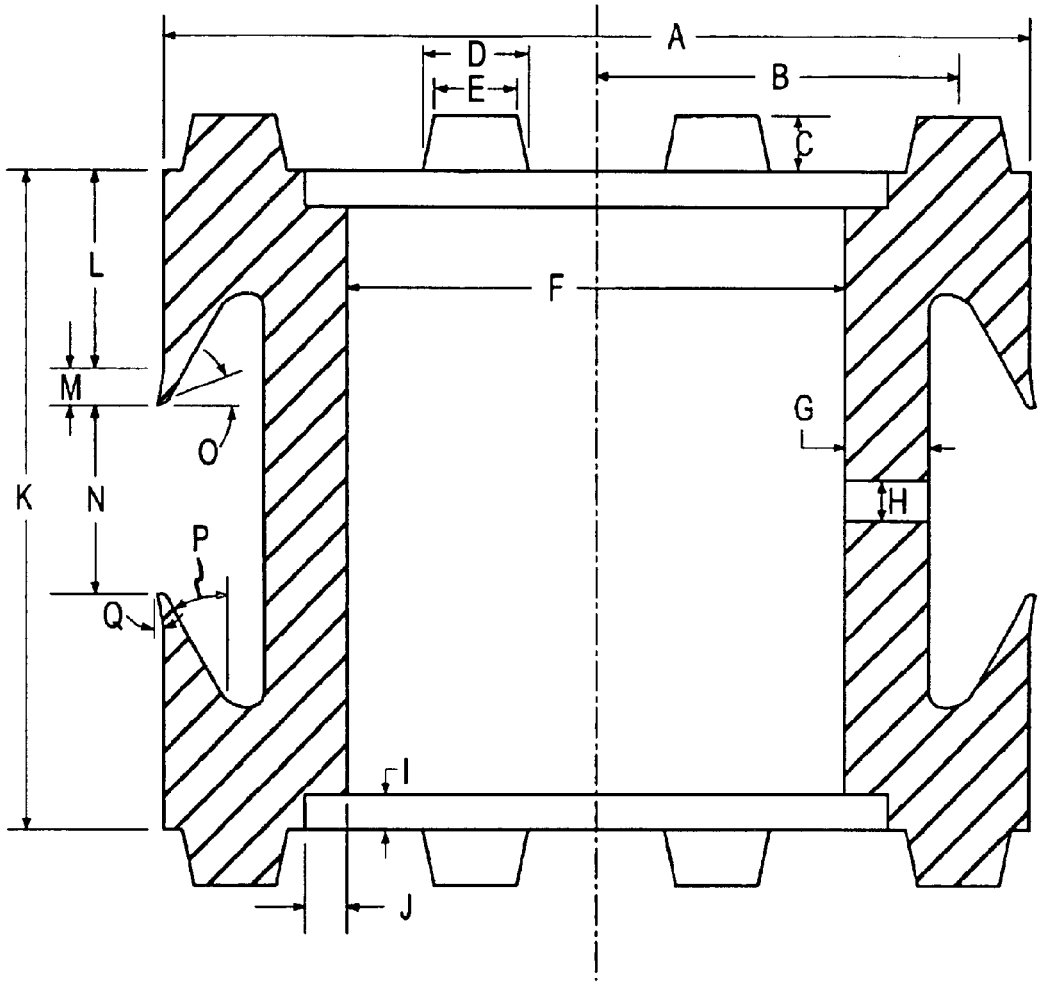
FIG. 16 is a sectional view showing the injection piece of the embodiment shown in FIGS. 5A and 5B with exemplary dimensions noted.

The injection piece 211*a*, as shown in FIGS. 5A and 5B, can be made of any desired size seal and lubricate around pipe of any desired outside diameter. To aid in the understanding of the invention, but not to be limited by the specific dimensions presented, FIG. 16 shows dimensions (with values listed in Table 1, with lengths provided both in inches and cemtimeters) for one example of a design of the injection piece 211*a* for lubricating and sealing around a pipe with an outside diameter of 4 inches (10.16 cm).

TABLE 1

| Dimension | Length (in.) | Length (cm) | Angle (°) |
|---|---|---|---|
| A | 8.750 | 22.225 | |
| B | 3.50 | 8.890 | |
| C | 0.625 | 1.588 | |
| D | 1.125 | 2.858 | |
| E | 1.000 | 2.540 | |
| F | 4.250 | 10.795 | |
| G | 1.000 | 2.540 | |
| H | 0.500 | 1.270 | |
| I | 0.500 | 1.270 | |
| J | 0.500 | 1.270 | |
| K | 9.250 | 23.495 | |
| L | 1.750 | 4.445 | |
| M | 1.125 | 2.858 | |
| N | 2.250 | 5.715 | |
| O | | | 5 |
| P | | | 30 |
| Q | | | 3 |

With reference again to FIGS. 4, 5A and 5B, in the embodiment of the injection piece 211*a* shown, the sealing wall 234*a* is of substantially uniform thickness between the pressurization cavity 217*a* and the outer surface of the sealing wall 234*a*. With this design, the sealing wall 234*a* will typically not deflect by a significant amount or will deflect only by a very small amount during operation when the pressurization cavity 217*a* is pressurized with hydrodynamic bearing fluid. This is because only a small pressure differential will normally be maintained across the sealing wall 234*a*. However, in some instances it may be beneficial to have the sealing wall 234*a* deflect by a more significant amount into the passage 201.

Figure 6:
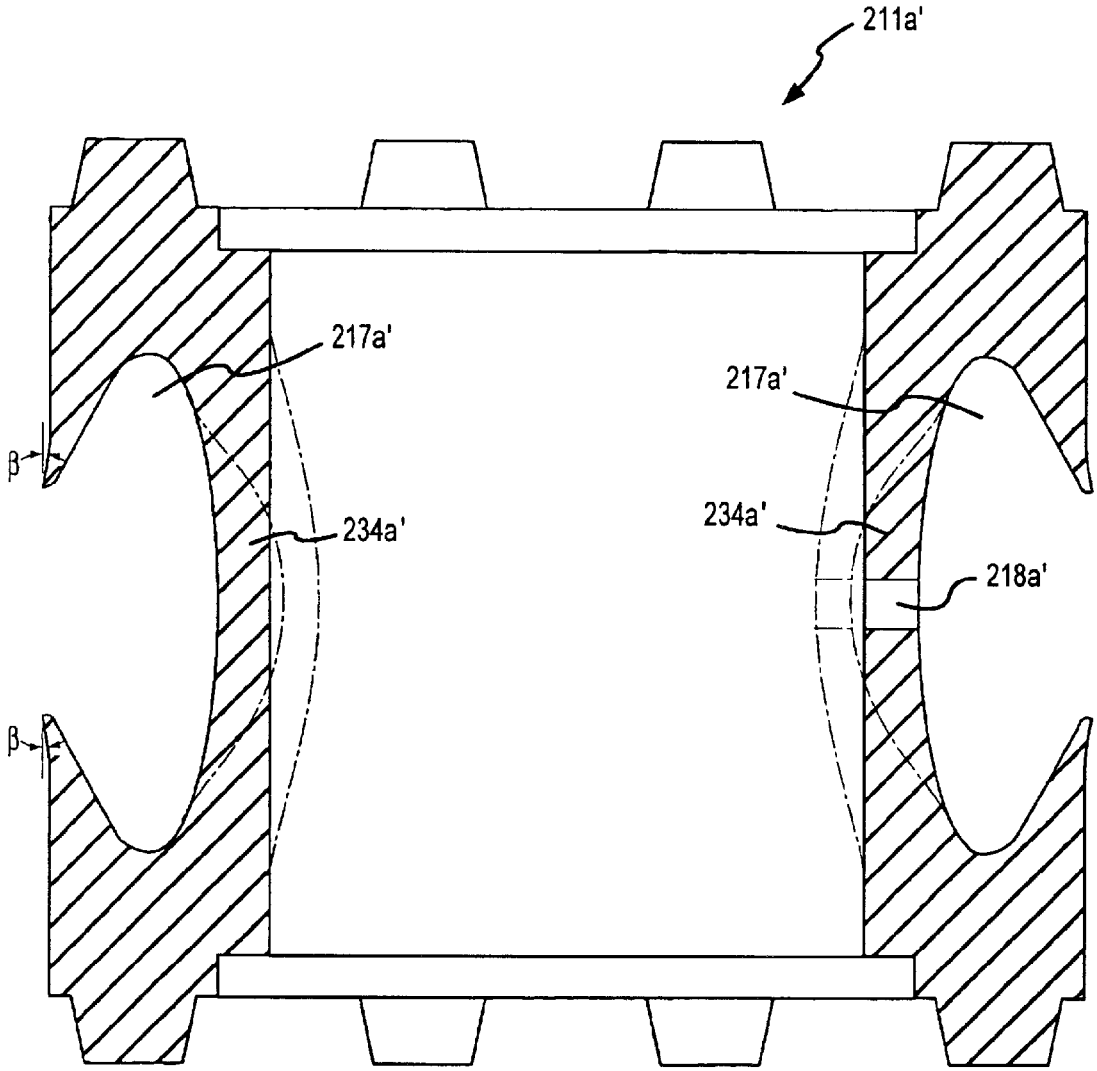
FIG. 6 is a sectional of another embodiment of an injection piece having a flexible bladder design for use in the sealing unit of FIG. 4.

Referring now to FIG. 6, a modified embodiment of an injection piece is shown, with reference numerals being designated with a prime to indicate an alternative design. The modified embodiment shown in FIG. 6 is the same as that shown in FIG. 5A, except as noted. As shown in FIG. 6, the injection piece 211*a*' includes a sealing wall 234*a*' that has varying wall thickness, in that the sealing wall 234*a*' has a smaller thickness toward the center of the pressurization cavity 217*a*' and a larger thickness near the upper and lower ends of the pressurization cavity 217*a*'. With this design, when the pressurization cavity 217*a*' is pressurized with hydrodynamic bearing fluid to cause hydrodynamic bearing fluid to be injected through the fluid port 128*a*', the sealing wall 234*a*' will tend to deflect to a greater degree adjacent the center of the pressurization cavity 217*a*', where the thickness of the sealing wall 234*a*' is smaller, as shown by the dashed lines showing an exemplary deflection of the sealing wall 234*a* when activated. Because of this variable deflection characteristic, the diameter of the passage through the injection piece 217*a*' is larger in the unactivated state than in the activated state. With this situation, it would be possible to move larger diameter objects through the sealing units 208*a,b* (as shown in FIGS. 2 and 3) by deactivating one of the sealing units 208*a,b* to permit the larger object to then pass the other of the sealing units 208*a,b*. In this way for example, oversize pipe collars could be passed through the sealing units 208*a,b*. This would, of course, not be necessary in the case of flush joint pipe, which is commonly used during drilling operations.

Figure 17:
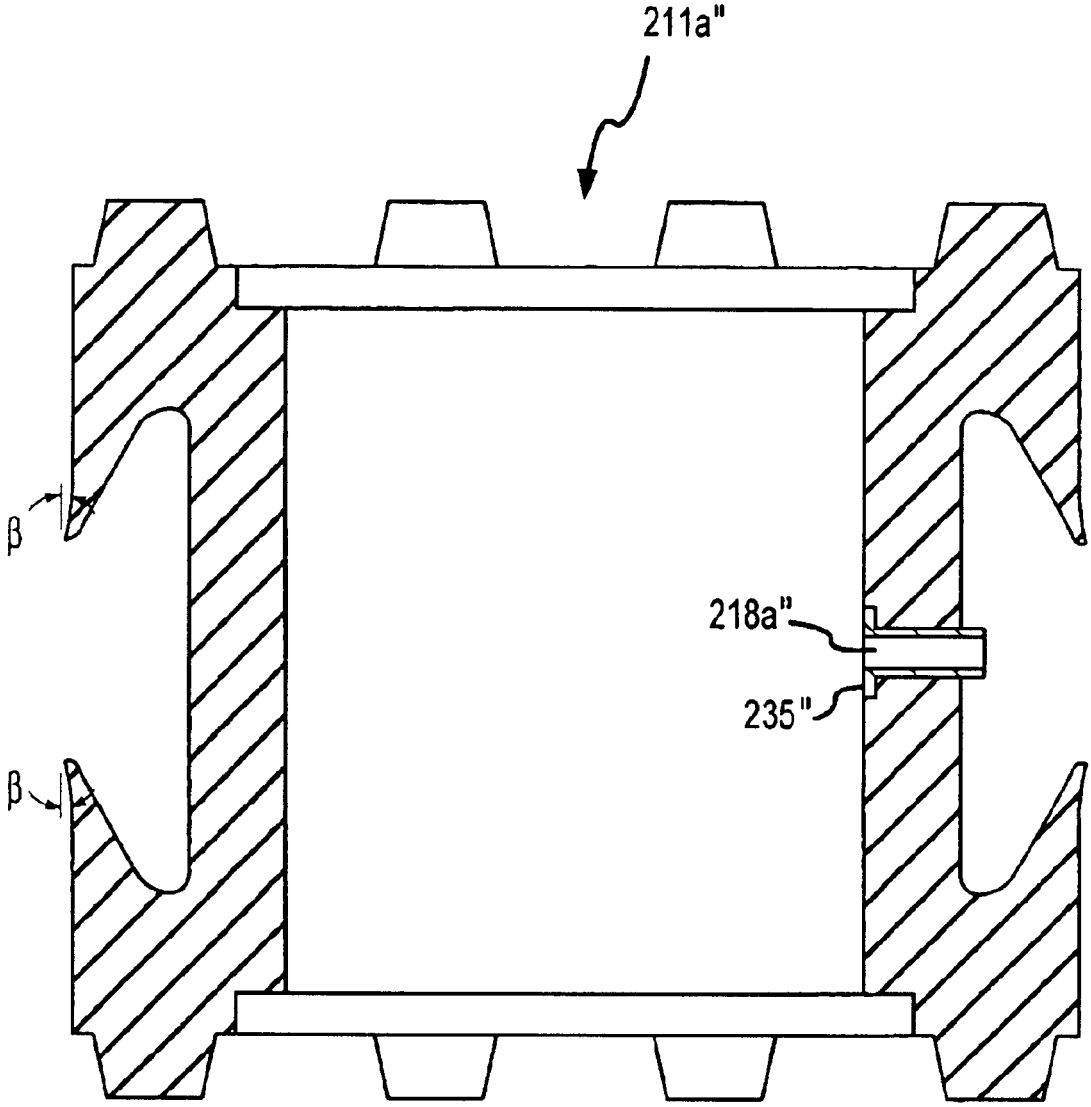
FIG. 17 is a sectional view showing another embodiment of an injection piece having a flexible bladder design for use in the sealing unit of FIG. 4.

Referring now to FIG. 17, another modified embodiment of an injection piece is shown, with reference numerals being designated with a double prime to indicate an alternative design. The modified embodiment shown in FIG. 17 is the same as that shown in FIG. 5A, except as noted. As shown in FIG. 17, the injection piece 211*a*" is modified to include an injection insert 235", with the fluid port 218*a*" extending through the injection insert 235". The diameter of the fluid port 218*a*" through the injection insert 235" can be any desired diameter, and the diameter of the fluid port can be changed simply by replacing the injection insert 235" with another insert having a different inside diameter, providing flexibility in adjusting the diameter of the fluid port for any particular application. The injection insert 235" can be made of any desired material, but is preferably made of a material with a high resistance to wear. One preferred material of construction for the injection insert 235" is phosphor bronze.

Figure 18:
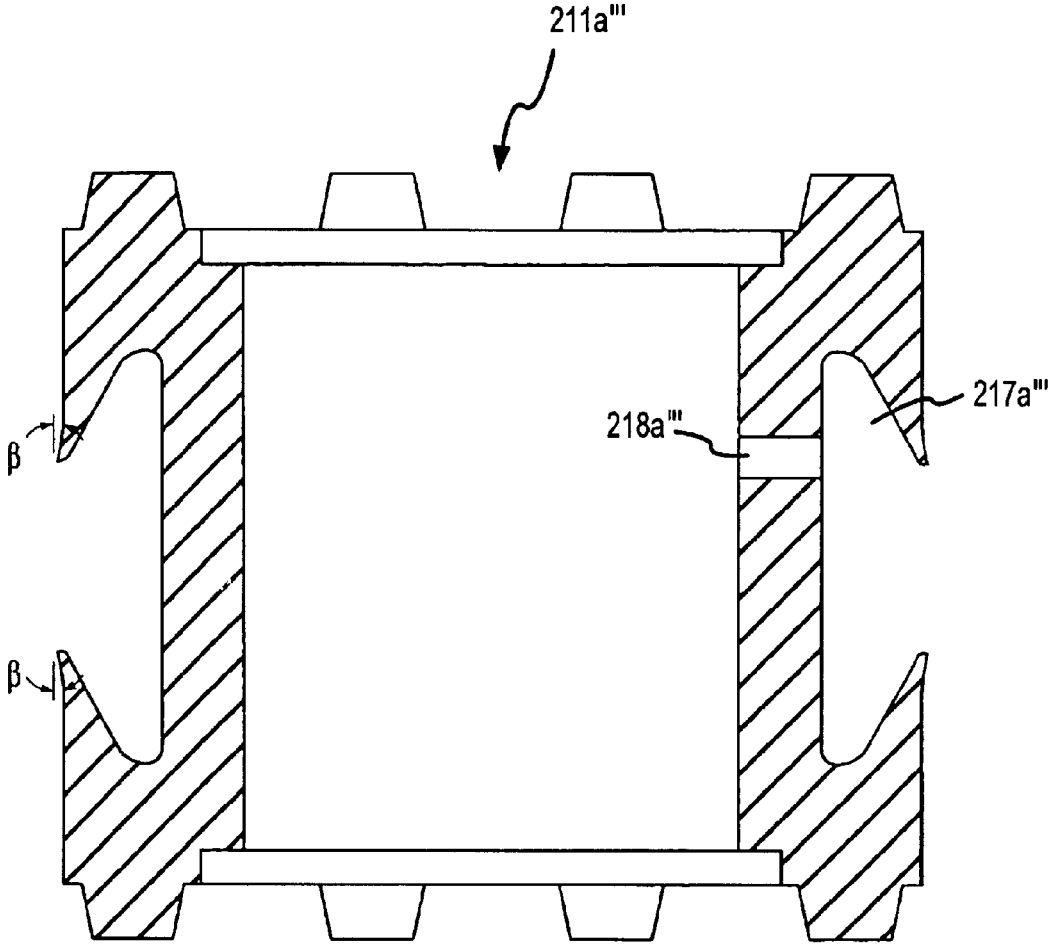
FIG. 18 is a sectional view showing another embodiment of an injection piece having a flexible bladder design for use in the sealing unit of FIG. 4.
Figure 19:
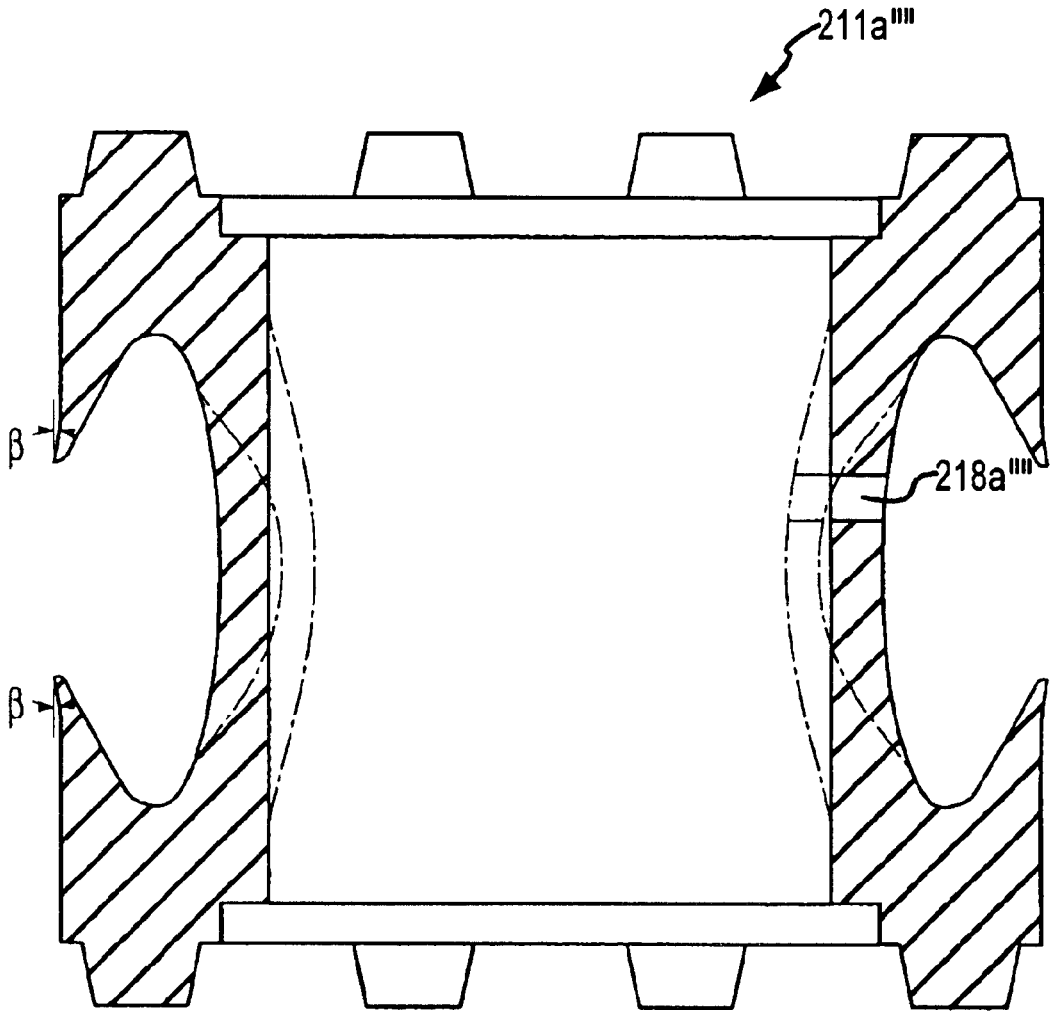
FIG. 19 is a sectional view showing another embodiment of an injection piece having a flexible bladder design for use in the sealing unit of FIG. 4.

Referring now to FIG. 18, another modified embodiment of an injection piece is shown, with reference numerals being designated with a triple prime to indicate an alternative design. The modified embodiment shown in FIG. 18 is the same as that shown in FIG. 5A, except as noted. As shown in FIG. 16, the injection piece 211*a*'" is modified so that the fluid port 218*a*'" has been moved to be located at a place that is not opposite the middle of the pressurization cavity 217*a*'". In this embodiment, hydrodynamic bearing fluid injected through he fluid port 218*a*'" will have an enhanced tendency to exit from the end of the injection piece 211*a*'" closest to the fluid port 218*a*'" (top end as shown in FIG. 18), because the hydrodynamic bearing fluid has farther to travel. This effect could be further enhanced by including a thin wall portion in the middle of the sealing wall, because the location of maximum deflection of the sealing wall during actuation will not correspond with the location of the fluid port. An example of this further modification is shown in FIG. 19, with reference numerals being designated with four primes to indicate an alternative design. In most situations when the fluid port is offset from the middle of the injection piece (such as in the examples shown in FIGS. 18 and 19), the injection piece will be incorporated into the annular pressure containment structure so that the fluid port will be located closer to the well, to promote leakage of hydrodynamic bearing fluid in the direction of the well. With reference to FIG. 3, such a situation would promote flow of hydrodynamic bearing fluid from the sealing unit 208*a* preferentially into the sealing unit space 223 and from the sealing unit 208*b* into the annular fluid manipulation unit 222. Although generally preferred, it is not necessary that the injection pieces in each of the sealing units 208*a* and 208*b* have the same design.

As noted previously, the embodiment of the sealing unit 208*a* shown in FIG. 4 includes two sealing rings 305 that help to retain the injection piece 211*a* in the proper shape when the sealing unit 208*a* is actuated by pressurization of the pressurization cavity 217*a* with a hydrodynamic bearing fluid. Each sealing ring 305 can be made in the form of a single ring, such as a metal ring having the proper dimensions to retain the injection piece 211*a*. In a preferred embodiment, however, the sealing rings 305 are comprised of multiple pieces. In this way, the sealing rings can be made more durable with respect to wear of inside surfaces from pipe sliding against the inside surfaces of the rings 305 during use.

Figure 20A:
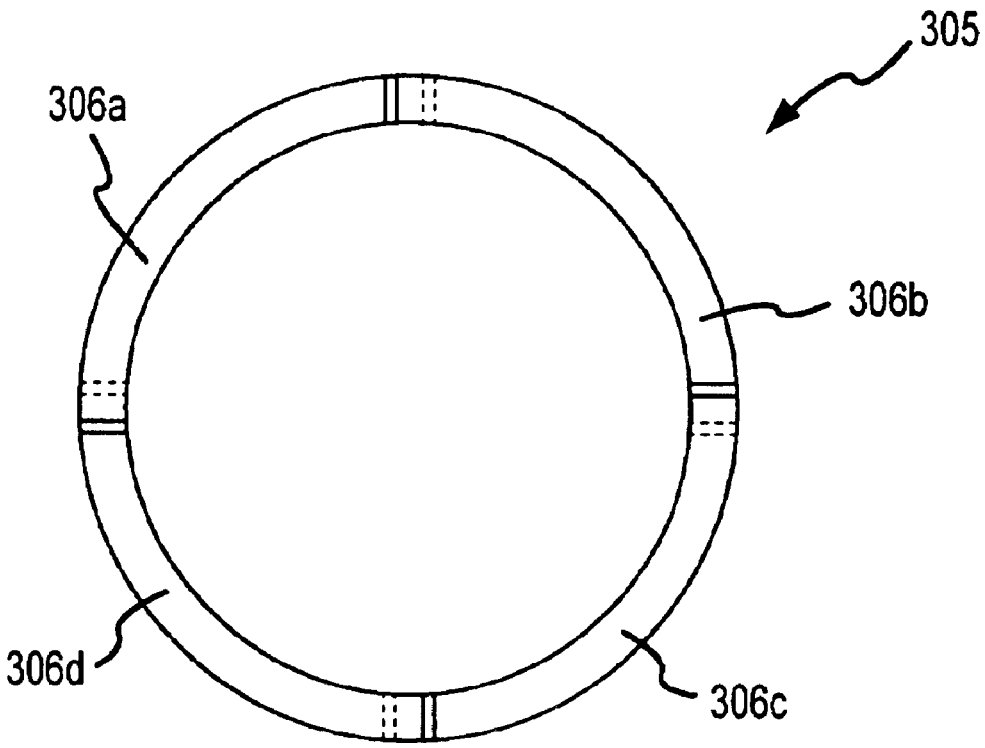
FIG. 20A is a top view of one embodiment of a sealing ring for use in the sealing unit of FIG. 4.
Figure 20B:
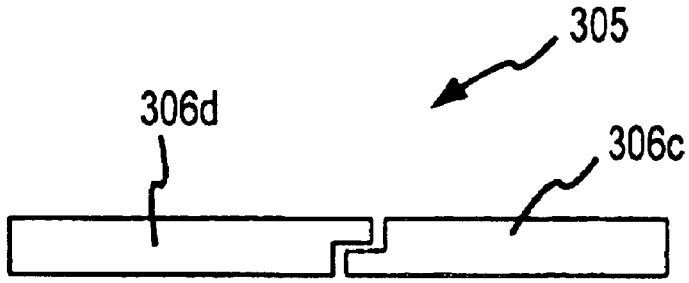
FIG. 20B is a side view of the sealing ring embodiment of FIG. 20A.

Referring to FIGS. 20A and 20B, one embodiment of such a multi-piece sealing ring 305 is shown. As shown in FIGS. 20A and 20B, the sealing ring 305 is made of four pieces 306*a–d*. Adjacent pairs of the pieces 306*a–d* have overlapping end portions (shown best in FIG. 20B for adjacent end portions of pieces 306*c* and 306*d*), with a gap between adjacent end portions to permit a small amount of relative movement between adjacent pieces 306*a–b*. The gap between the adjacent end portions of the pieces 306*a–d* is very small. For example, for a sealing ring 305 having an internal diameter of about 4.25 inches (10.8 cm) the gap might be on the order of only 0.1 inch (0.25 cm) or even smaller. With reference to FIGS. 20A and 20B and to FIG. 4, when the sealing unit 208*a* is actuated, deformation of the injection piece 211*a* tends to push the pieces 306*a–d* together around the pipe 300, so that the sealing rings 305 close around outside of the pipe 300. As the inside surfaces of the sealing rings 305 are worn away by the pipe 300 during operation, the deformation of the injection piece 211*a* continues to push the injection pieces 306*a–b* together around the pipe, thereby reducing the gap between the pieces 306*a–d* over time to maintain a close fit of the sealing rings 305 around the outside of the pipe 300. In this way, the useful life of the sealing rings is lengthened.

As noted previously, the pressure of hydrodynamic bearing fluid injected to help maintain the annular pressure seal and to provide the desired lubrication should be at a pressure that is larger than the pressure in the annular area being sealed (e.g., the annular space 301 in FIG. 3). A significant advantage of the present invention is that the pressure of injected hydrodynamic fluid can be controlled to quickly accommodate pressure changes that occur in the annular area to be sealed. Such pressure changes can occur during drilling for example when pockets of either higher or lower pressure are drilled into. Referring again to FIG. 3, during normal operation, an operator can visually observe the rate of discharge of hydrodynamic bearing fluid out of the fluid port 232 and out of the end of the sealing unit 208*a*. Adjustments can then be made to the pressure of the hydrodynamic bearing fluid in one or both of the pressurization cavities 217*a,b* to increase or decrease the flow of the hydrodynamic bearing fluid. In a preferred operation, the flow of the hydrodynamic bearing fluid in each of the sealing units 208*a,b* is just sufficient to maintain adequate lubrication of the pipe 300. If the flow of hydrodynamic bearing fluid is too low, the sealing walls 234*a,b* will tend to wear out more quickly and if the flow of the hydrodynamic bearing fluid is too high, the leakage of hydrodynamic bearing fluid will be greater than desired.

Figure 7:
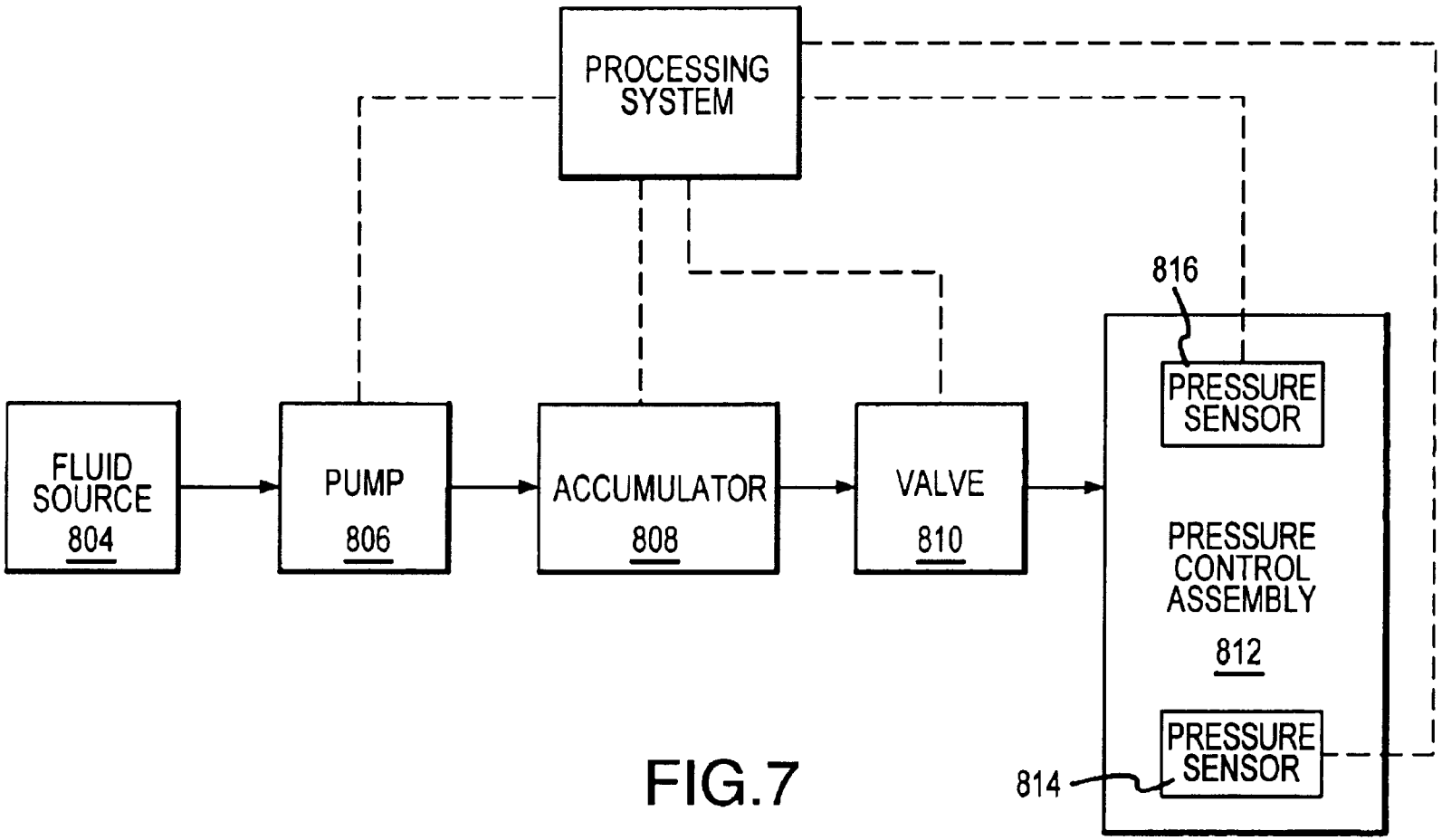
FIG. 7 is a schematic showing one embodiment of a control system for controlling operation of the sealing structure in the annular pressure containment structure.
Figure 8:
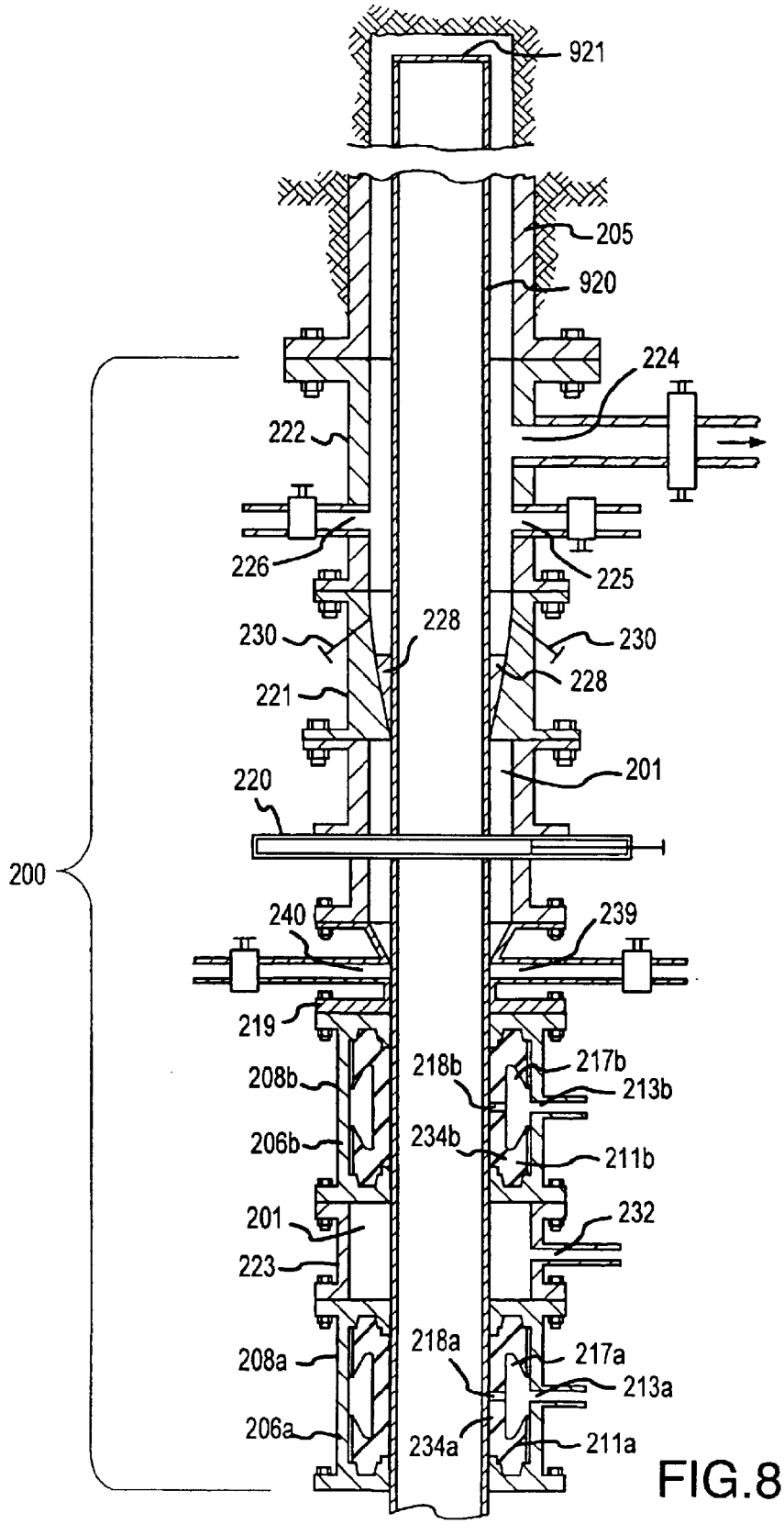
FIG. 8 is a sectional view showing one embodiment of the annular pressure containment structure showing the securing of production pipe with a collet unit in a well extending in an upward direction.

In addition to the noted manual control, automated control can also be implemented, especially to handle upset situations, such as rapid increases or decreases in pressure being exerted by the well during drilling operations. Referring now to FIG. 7, one embodiment for automated control of the operation of a sealing unit (such as the sending units 208*a,b* shown in FIGS. 2–4) will be described. During a well operation, such as the drilling described with reference to FIG. 3, one or more sealing units in a pressure control assembly 802 are actuated by pressurization with a hydrodynamic bearing fluid, as previously discussed. As shown in FIG. 8, in one embodiment a hydrodynamic bearing fluid delivery system includes a fluid source 804, a pump system 806, a pressure accumulator system 808 and a control valve system 810. The hydrodynamic bearing fluid delivery system also includes a processing system 812 that controls delivery of the hydrodynamic bearing fluid to the pressure control assembly and automatically makes adjustments to the delivery of the hydrodynamic bearing fluid.

During operation, hydrodynamic bearing fluid is delivered to the pressure control assembly from a pressurized accumulation of the hydrodynamic bearing fluid in the pressure accumulator system 808. The pressure accumulator system 808 includes apparatus capable of being charged with a pressurized volume of incompressible fluid (e.g., the hydrodynamic bearing fluid) and for delivery of that incompressible fluid in a pressurized state. For example, the pressure accumulator system 808 could include a bladder-type accumulator in which a gas is disposed outside of the bladder and is compressed and pressurized as the hydrodynamic bearing fluid is charged into the inside of the bladder. Hydrodynamic bearing fluid exiting the pressure accumulator system 808 passes through the control valve system 810 prior to delivery to the pressure control assembly 802. The pressure accumulator system 808 is charged with hydrodynamic bearing fluid via a pump system 806 that transfers hydrodynamic bearing fluid from the fluid source 804, which is typically one or more tanks filled with the hydrodynamic bearing fluid, to the pressure accumulator system 808.

The pressure of the hydrodynamic bearing fluid in the accumulator must be maintained at a pressure that is at least higher than the highest annular pressure that is expected to be contained within annular pressure containment structure of the pressure control assembly. In some cases, this could be several thousand psi. During operation, the processing system 812 monitors the pressure in the accumulator and activates the pump system 806 when required to charge the pressure accumulator 808 system.

The processing system 812 could include instructions that are stored on a storage media. The instructions can be retrieved and executed by a processor. Some examples of instructions are software, program code, and firmware. Some examples of storage media are memory devices, tape, disks, integrated circuits, and servers. The instructions are operational when executed by the processor to direct the processor to operate in accord with the invention. The term "processor" refers to a single processing device or a group of inter-operational processing devices. Some examples of devices are integrated circuits and logic circuitry. The processing system 812 could comprise, for example, one or more dedicated process controllers or one or more general purpose computers programmed to analyze data and generate control signals to effect the desired process control.

The pressure control assembly 802 includes at least two pressure sensors 814 and 816, each capable of sending pressure measurement signals to the processing system 812 corresponding to signal pressure levels. Pressure sensor 814 senses pressure of hydrodynamic bearing fluid in a sealing unit, such as the pressure of the hydrodynamic bearing fluid in the pressurization cavity 217*b* of the sealing unit 208*b* shown in FIGS. 2–4. Pressure sensor 816 senses the pressure within the annular space to be sealed, such as the pressure in the annular space 301 in the annular pressure containment structure shown in FIG. 3. During operation, the processing controller monitors the relevant pressures via measurement signals received from the pressure sensors 814 and 816 and makes adjustments to open or close one or more control valves in the control valve system 810 based on an analysis of the measurement signals. For example, when the processing system 812 identifies an increase in the pressure within the monitored annular space, the processing system 812 will send a control signal to the control valve system 810 to open one or more control valves by some predetermined amount so that the pressure of hydrodynamic bearing fluid in the appropriate sealing unit or units will be increased to ensure that the pressure of the hydrodynamic bearing fluid in the relevant sealing unit(s) is adequate to contain the pressure in the annular space. Likewise, when the processing system 812 identifies a drop in the monitored annular pressure, a control signal can be sent to the control valve system 810 to close by some predetermined amount one or more control valves to reduce the pressure of the hydrodynamic bearing fluid in the relevant sealing unit(s).

One aspect of the present invention involves completion and production of wells, and especially wells that extend in a vertically upward direction, such as drain holes drilled upward into a petroleum reservoir from a subterranean site. Referring now to FIG. 8, the annular pressure containment structure 200 is shown. The annular pressure containment structure 200 is the same as that described previously with reference to FIGS. 2 and 3. As shown in FIG. 8, however, a production pipe 920 is inserted into the well through the passage 201. The production pipe 920 will serve as a production casing for the well through which hydrocarbon fluids will be drained from the well during production. To retain the production pipe 920 securely in place, the retaining screws 230 have been loosened, but not removed, to permit the collets 228 drop into place around the production pipe 920, thereby securing the production pipe at the wellhead for producing operations. The collets act as a wedge between the housing of the collet unit and the production pipe 320 to retain the production pipe 320. The production pipe 320 is then secured in a manner similar to hanging pipe from slips during conventional drilling operations except that in the conventional drilling situation the pipe is in tension hanging in a downward direction from the slips, while in the case of a drain hole as shown in FIG. 8, the production pipe 920 that extends upward into the well is in compression. Each collet 228 is shaped with a curved surface facing the production pipe 920 that corresponds with and bears against the rounded outer surface of the production pipe 920. Each collet 228 has another curved surface on the opposite side that faces the housing of the collet unit 221 and that corresponds with and bears against the inside surface of the housing of the collet unit 221. Each collet 228 has a tapered thickness from top to bottom so that each collet will securely wedge between the outside surface of the production pipe 920 and the inside surface of the housing of the collet unit 221 to hold the production pipe in place. Three or more of the collets 228 are included in collet unit 221, with the collets 228 radially spaced around the outside of the production pipe 320. If desired to effect a permanent annular seal around the production pipe 920, cement, wax or another sealant can be deposited around the outside of the production pipe 920 on top of the collets through one or both of fluid port 225 and fluid port 226. As will be appreciated, the production pipe 920 should be positioned for setting the collets 228 with a pipe connection joint located just below the bottom of the collets 228 and above the gate valve 220.

As shown in FIG. 8, the production pipe 920 is closed at its distal end inside the well with a sealing cap 921 that seals the distal end of the production pipe 920 so that there is no fluid communication between the well and the interior volume of the production pipe 920. Furthermore, in a preferred embodiment for completing the well, the interior volume of the production pipe 920 is evacuated (i.e., free of liquid) when inserted into the well. The sealing cap 921 can be any structure that maintains the desired seal between the interior volume of the production pipe 920 and the well. The sealing cap 921 could, for example, be a cap screwed onto the end of the production pipe 920 through a threaded connection, or could be a small metal plate welded to the end of the production pipe 920.

For completion of the well for production, the bit retainer unit 219, sealing units 208*a,b* and sealing unit spacer 223 are removed. With continued reference to FIG. 8, removal of these units is accomplished by first disconnecting the production pipe 920 at a pipe connection joint located between the bottom of the collets 228 and the gate valve 220. The free disconnected portion of the production pipe 920 (i.e., the portion not secured by the collets 228) is then withdrawn from the annular pressure containment structure 200 until the distal end of the free portion of the production pipe 920 is below the gate valve 220. The gate valve 220 is then closed to shut-in the well and the free portion of the production pipe 920 is then completely withdrawn from the annular pressure containment structure 200. The sealing unit 208*a*, sealing unit spacer 223, sealing unit 208*b* and bit retainer unit 222 can then be removed in that order to permit further completion operations to be performed on the well.

Figure 9:
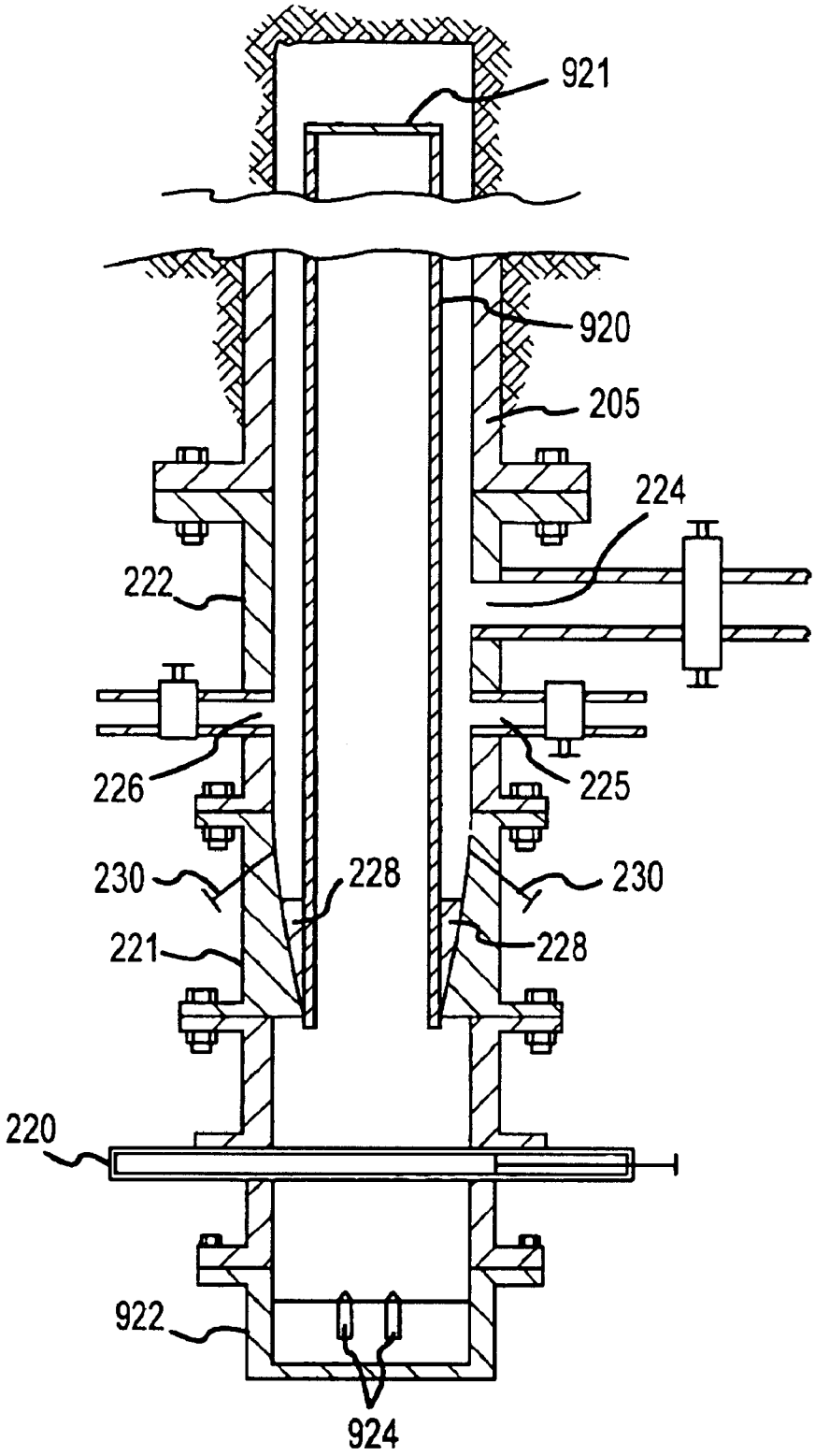
FIG. 9 is a sectional view showing one configuration of the present invention useful for perforating a well that extends in an upward direction.

Referring now to FIG. 9, the well is shown with a wellhead assembly of the present invention including a perforating unit 922 connected to the gate valve 220. The perforating unit 922 includes a plurality of perforating guns 924 for perforating the sealing cap 921 with holes for fluid communication between the well and the interior volume of the production pipe 920, thereby permitting hydrocarbon fluids from the hydrocarbon bearing reservoir to enter into drain out of the well through the production pipe 920. The perforating guns 924 each include a charge of a propellant, such as gun powder, and a projectile, such as a bullet. When a perforating gun 924 is fired, or actuated, with the gate valve 220 open, each projectile is propelled in the direction of the sealing cap 921 with such a force that the projectile pierces a hole through the sealing cap 921. Any debris resulting from firing the perforating guns 924 will fall down the well and be collected in the perforating unit 922.

Figure 10:
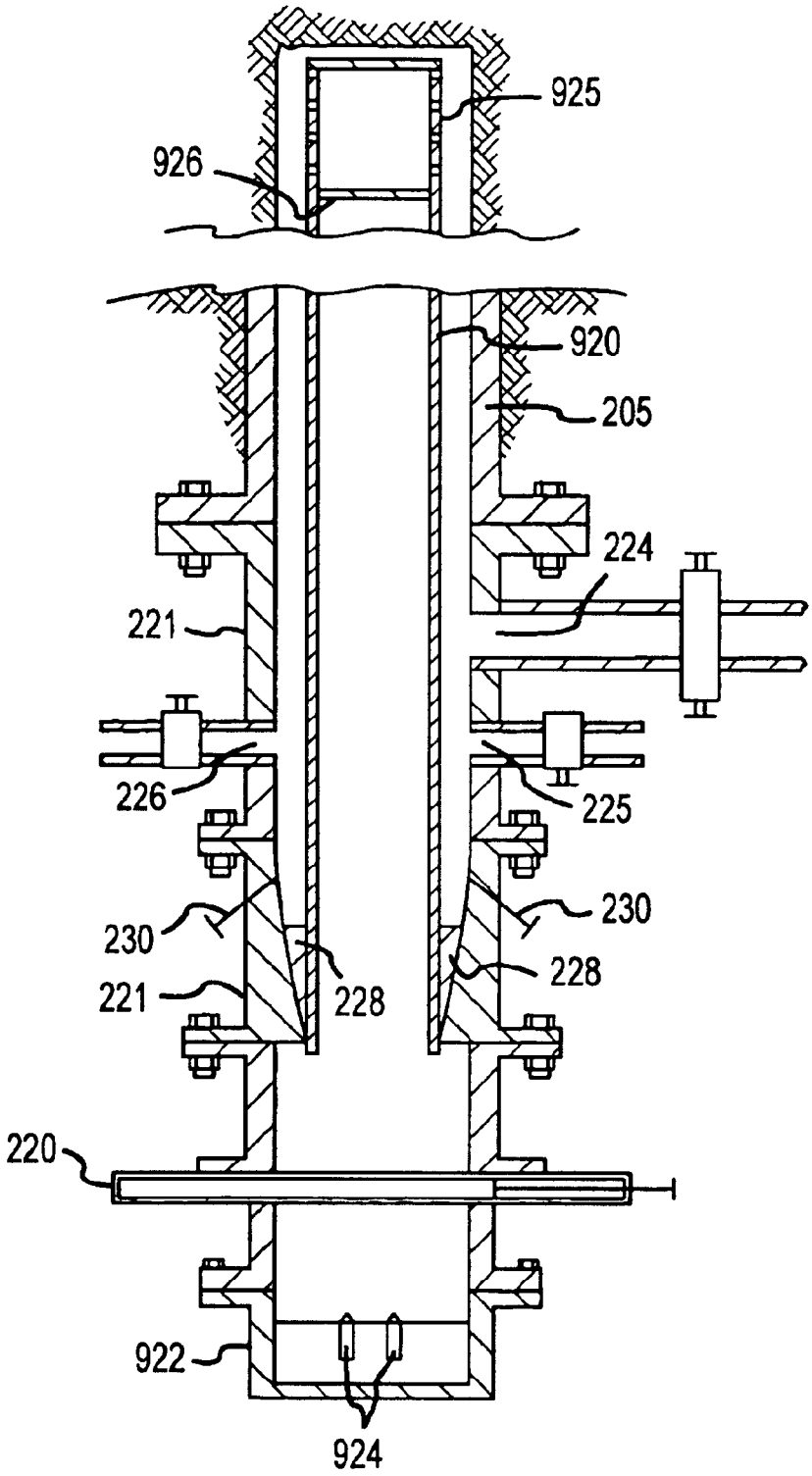
FIG. 10 is a sectional view showing one embodiment of the present invention for perforating a well that extends in an upward direction.

An alternative embodiment for completing a well is shown in FIG. 10, where the production pipe 920 has a pre-perforated section 925 adjacent the distal end in the well and a sealing piece 926 that seals the pre-perforated section 925 from fluid communication with the lower interior volume of the production pipe 920. When the perforating guns 924 are fired, holes are perforated through the sealing piece 926 to permit fluid communication between the well and the interior volume of the production pipe 920 for draining hydrocarbon fluids from the well during production. The pre-perforated section 925 could be, for example, a slotted pipe section or a screen. Also, in one possible enhancement (not shown in FIG. 10), a sand pack could be attached to and surround the pre-perforated section 925 to limit the entry of formation fines into the production pipe 920 during hydrocarbon production.

Figure 11:
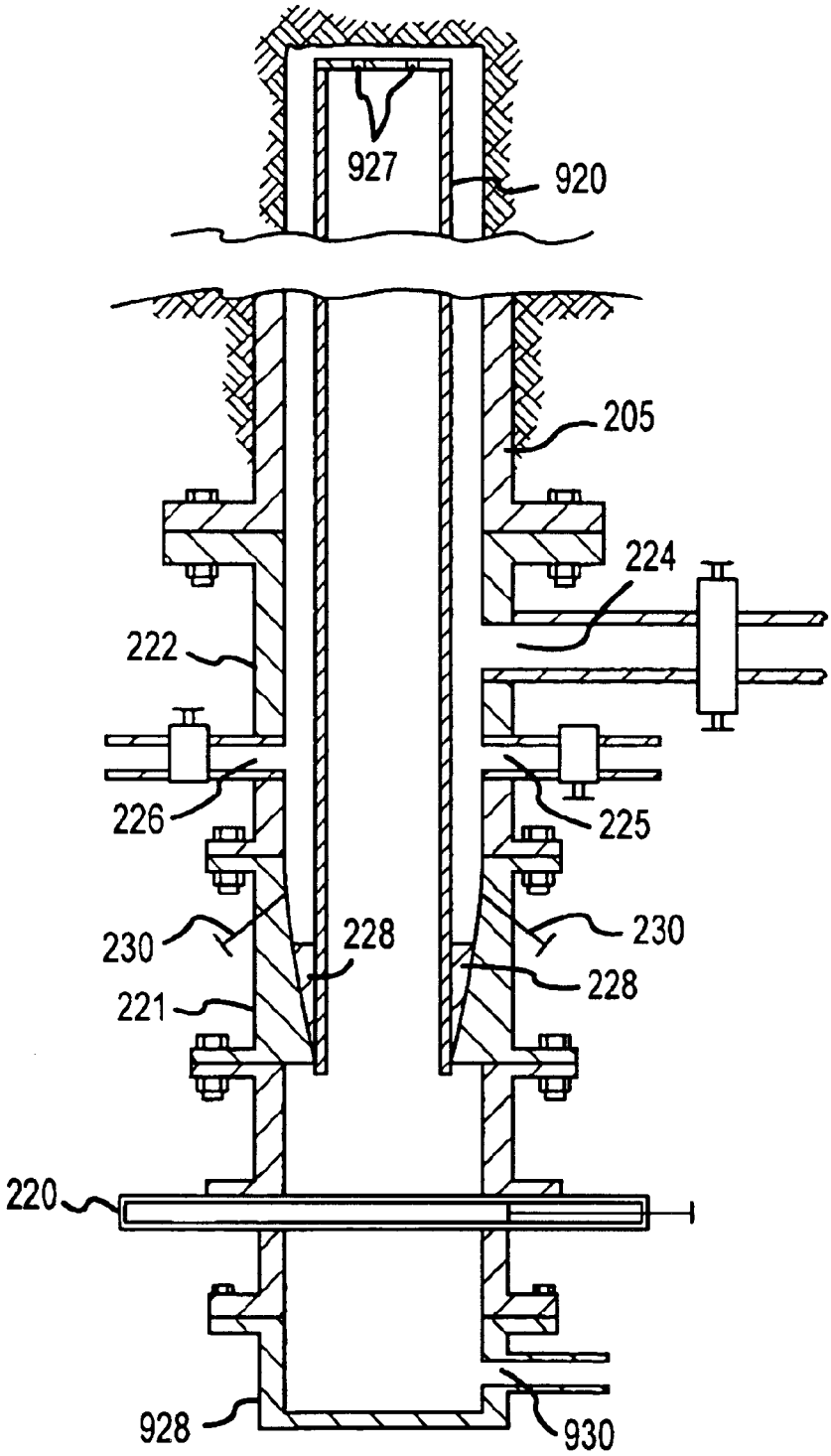
FIG. 11 is a sectional view showing one wellhead configuration useful for producing hydrocarbon fluids from a well that extends in an upward direction.

After completion of the perforation operation, the well would then be placed on production so that hydrocarbon fluids can drain out of the well and be collected. Referring now to FIG. 11, one embodiment of a wellhead assembly for production of hydrocarbon fluid from the well is shown. The wellhead assembly shown in FIG. 11 is the same as that shown in FIG. 10, except that the after being fired, the perforating unit 922 (shown in FIG. 9) has been removed and a production unit 928 has been connected to the gate valve 220. Perforations 927 through the sealing cap 921 made by firing the perforating guns (shown in FIG. 9) permit hydrocarbon fluids from the hydrocarbon-bearing reservoir to enter into the interior volume of the production pipe 920. When the gate valve 220 is opened, produced fluids will drain from the well through the production pipe 920 and into the production unit 928, where the produced fluids are directed through a fluid port 930 into a produced fluid collection system (not shown). The collection system is preferably a closed system in which the produced fluids are collected and pumped to the surface for storage and/or further processing. Also, in one enhancement of the present invention, water can be injected into the well through any of the fluid ports 224, 225 and 226 simultaneously with withdrawal of produced fluids through the production unit 928. This would be desirable, for example, when the well extends across an oil-water contact in a petroleum reservoir or across an oil-gas contact in a gas reservoir. In the case of a petroleum reservoir, for example, the water would be injected through the annular space outside of the production pipe 920 into the petroleum reservoir below the oil-water contact and the perforations 927 would be located above the oil-water contact to drain oil from the petroleum reservoir above the oil-water contact. Such injection of water is beneficial for both disposal of produced water and for maintaining pressure in the petroleum reservoir to promote maximum oil recovery. With the embodiment shown in FIG. 11, with the well extending upward from a subterranean excavation, the hydrostatic head of water coming down an access shaft from the surface should be sufficient for the injection, with the injection rate being controlled by appropriate pressure regulation and valving. The water injected through the annular space around the production pipe could include water previously produced from the reservoir and separated from petroleum on the surface, and/or could include waste water from other petroleum reservoirs or from other sources. When using water from another reservoir or from another source, it is important that the water be compatible with the reservoir into which the water is injected. For example, the water should not cause swelling of clays in the formation.

Figure 12:
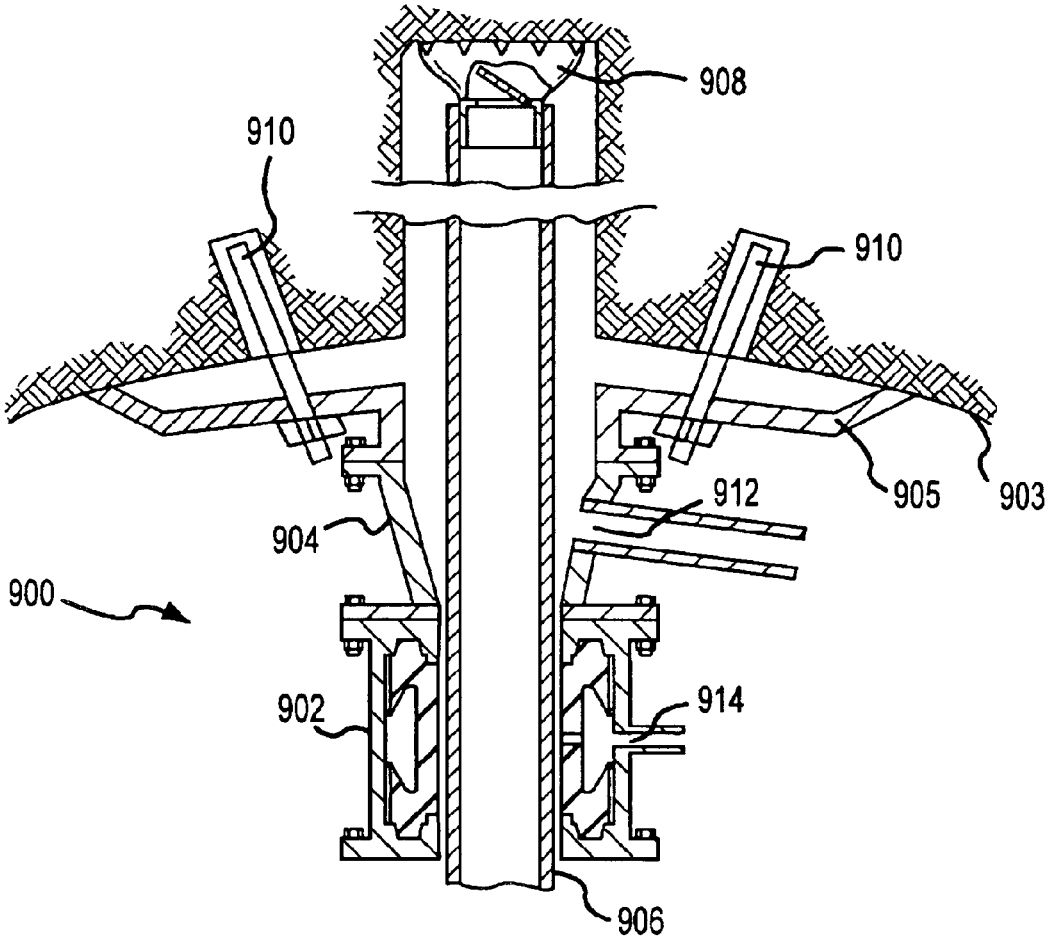
FIG. 12 is a sectional view showing one embodiment of the present invention useful for drilling an initial anchor hole for setting anchor casing in a well that extends in an upward direction.

In one aspect, the present invention involves starting a hole and setting anchor casing to then support drilling operations for drilling drain holes upward into a hydrocarbon-bearing reservoir. Referring now to FIG. 12, an embodiment of an annular pressure containment structure is shown for initiating drilling operations. As shown in FIG. 12, an annular pressure containment structure 900 includes a sealing unit 902, a bit retainer unit 904 and a shield 905. Passing through the passage through the annular pressure containment structure 900 is a pipe 906, with a drill bit 908 attached to the distal end of the pipe 906. The annular pressure containment structure 900 is secured to the roof 903 of a subterranean mine excavation by rock bolts 910. The bit retainer unit 904 and the sealing unit 902 have the same designs as discussed previously with respect to the sealing units 208 and the bit retainer unit 219 shown in FIGS. 2 and 3. The shield 905 can be made of any suitable material, but is preferably made of rubber material that will tend to deform to form at least a rough seal against the roof 903.

With continued reference to FIG. 12, the annular pressure containment structure 900 would be used to drill a shallow hole for the purpose of setting anchor casing through which further drilling could then be conducted, such as drilling of the well in a manner as described previously with reference to FIG. 3. During drilling with the annular pressure containment structure 900, the pipe 906 and the drill bit 908 would be rotated to drill the hole and cuttings would be removed through a fluid port 912. Preferably, a working fluid, such as water or air, is circulated through the pipe 906 and out of the well deepening hole through the annular space around the outside of the pipe 906, exiting the bit retainer unit 904 through the fluid port 912 along with the cuttings. The shield 905 directs the working fluid and cuttings into the bit retainer for removal. Also, when the working fluid is air, the shield advantageously prevents excessive dust from cuttings. Working fluid and cuttings exiting through the fluid port 912 can then be processed for removal of the cuttings in a closed system. During the drilling, hydrodynamic bearing fluid would be introduced into the sealing unit through a fluid port 914 to effect a seal around the outside of the pipe 906. After drilling the anchor hole to a sufficient depth to accommodate the anchor casing, usually from about 5 to 20 meters deep, then the sealing unit 902 and the bit retainer unit 904 would be removed for running and setting anchor casing in the hole to support further drilling operations.

Figure 13:
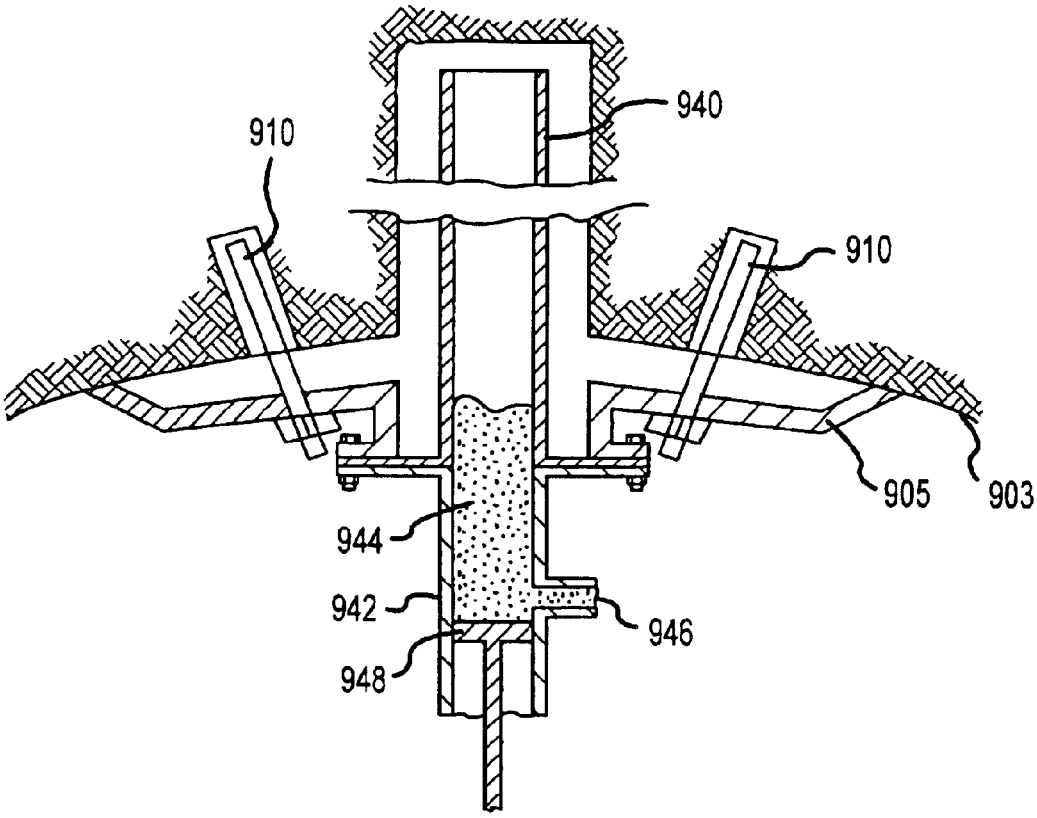
FIG. 13 is a sectional view showing one embodiment of the present invention for cementing anchor casing for a well that extends in an upward direction.
Figure 14:
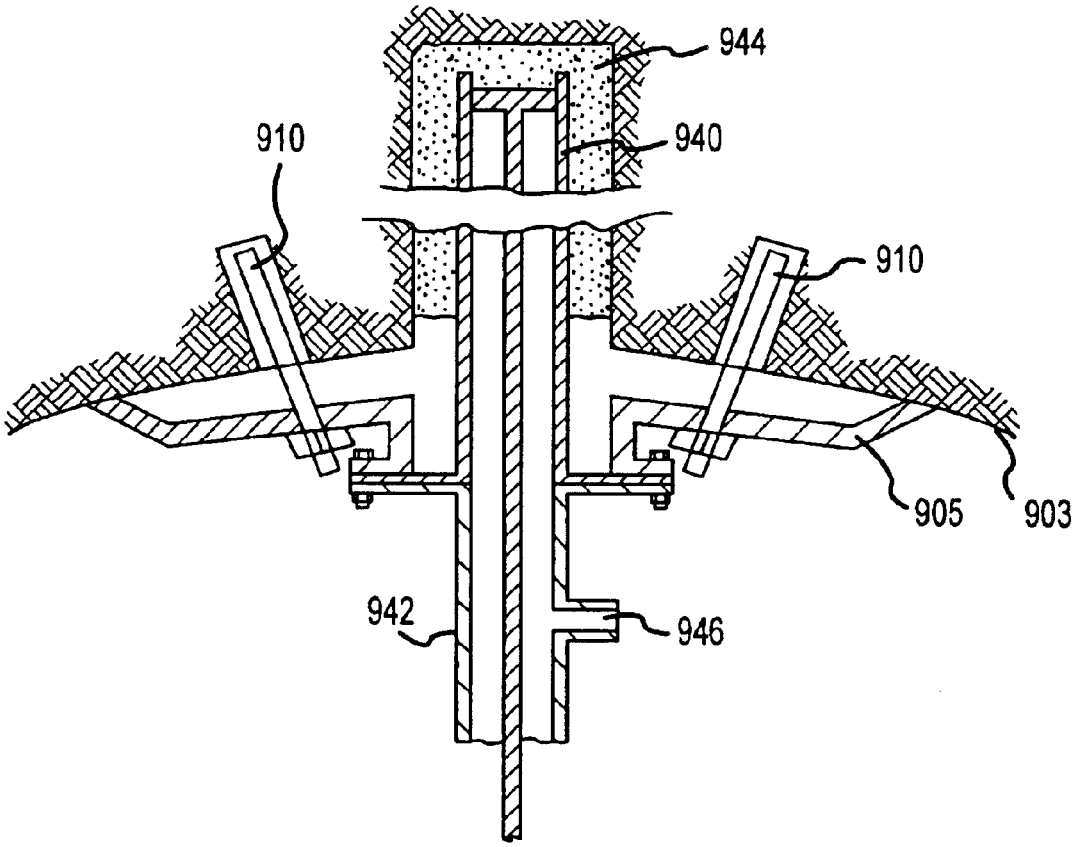
FIG. 14 is a sectional view showing the embodiment of FIG. 13 following placement of the cement around the anchor casing.

Referring now to FIG. 13, one embodiment of the present invention is shown for cementing anchor casing in an initial hole drilled for the purpose of setting the anchor casing. The initial hole could have been formed by drilling in accordance with the present invention as described above with reference to FIG. 12. As shown in FIG. 13, anchor casing 940 has been run into the anchor hole and connected with a cementing unit 942. Cement 944 has been pumped into the interior volume of the cementing unit 942 through a fluid port 946, so that the cement 944 rests on top of a plunger 948 disposed in the cementing unit 944. Referring now to FIG. 14, the plunger 948 has been pushed up into the well to near the distal end of the anchor casing 940 to force cement out of the distal end of the anchor casing 940 and around the outside of the anchor casing 940 to secure the anchor casing 940 and to provide a fluid seal around the outside of the anchor casing 940.

Figure 15:
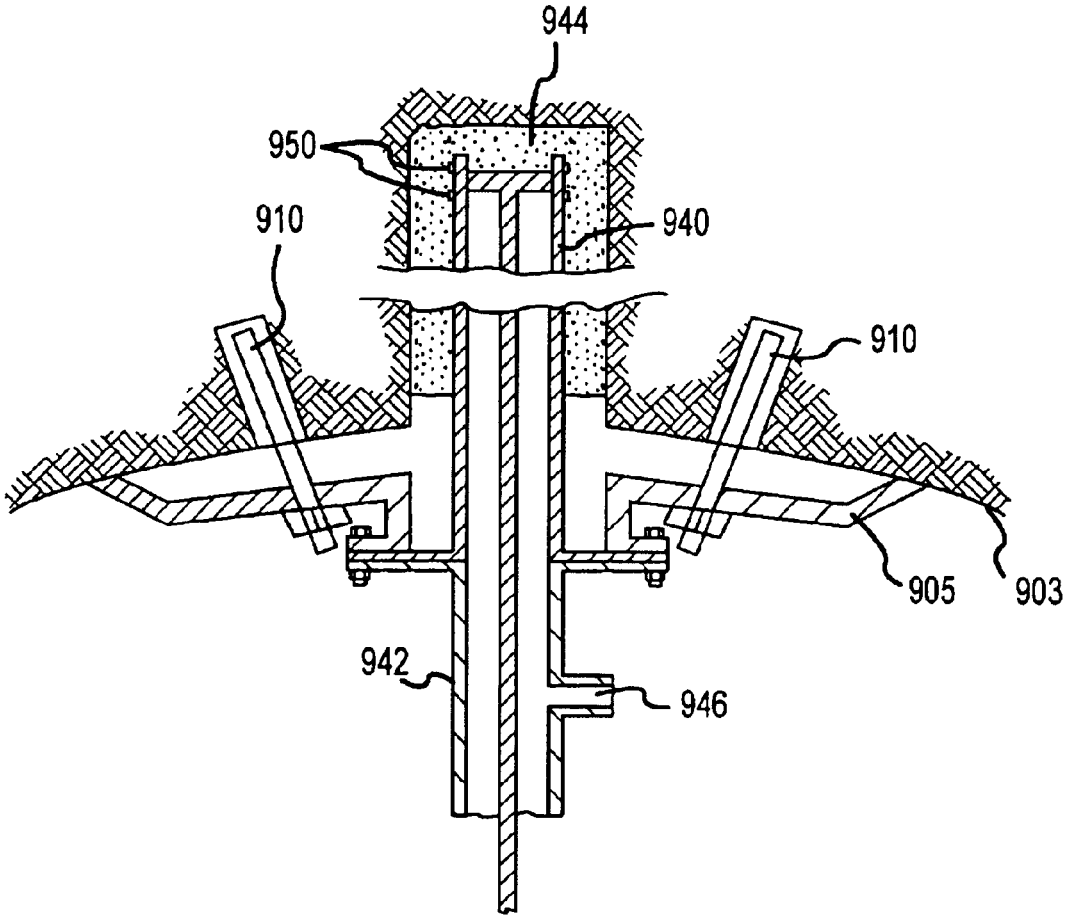
FIG. 15 is a sectional view showing another embodiment of the present invention for cementing anchor casing for a well extending in an upward direction.

In one enhancement, surface irregularity can be provided on the outside of anchor casing to assist in securing the anchor casing in the cement. FIG. 15 shows one possibility for such an embodiment, where projections 950 are provided on the outside of the anchor casing 940. Such projections 950 could be, for example, metal collars welded to the outside of the pipe. Other surface features, however, could be used instead to provide the surface irregularity, if desired.

Hydrocarbon fluids produced from wells drilled, completed and/or produced in accordance with aspects of the present invention can be processed alone or with other produced hydrocarbon fluids to prepare hydrocarbon products. In one aspect, the present invention provides a method for preparing a hydrocarbon fluid product from hydrocarbon fluids produced from the wells. In one embodiment of this method, for example, a well is drilled into a hydrocarbon-bearing subterranean formation using a well pressure control assembly as previously discussed, followed by extraction of at least one hydrocarbon, preferably petroleum, from the well. The hydrocarbon fluid can be refined to produce a refined hydrocarbon product. In the case of extraction of petroleum, for example, the refining could involve distillation and the refined hydrocarbon product could be a petroleum distillate. In the case of extraction of a hydrocarbon gas, the refining could comprise drying the gas and/or removing LPG components from the gas. The refined hydrocarbon product could be, for example, an LPG or a dry pipeline quality gas. In another embodiment, the refining could comprise chemical modification of at least one component of the hydrocarbon fluid. For example one or more petroleum distillate fractions could be cracked, reformed, isomerized or otherwise chemically modified. In a further embodiment, the refined hydrocarbon product is blended with other components to form a blended product, such as a motor fuel, which could be, for example, a diesel fuel, gasoline or jet fuel.

Those skilled in the art will appreciate variations of the above-described embodiments that fall within the scope of the invention. As a result, the invention is not limited to the specific examples and illustrations discussed above, but only by the following claims and their equivalents. Furthermore, any feature described with respect to any embodiment of any aspect of the invention can be combined in any combination with any other feature of any other embodiment of any aspect of the invention. For example, any feature shown in or discussed in relation to any of FIGS. 1–15 can be combined in any combination with any other feature shown in or discussed in relation to any of FIGS. 1–15, except to the extent that the features are not fundamentally compatible in the combination. Also, the terms "comprising," "having," "containing," and "including," including variations of these terms, are not intended to be exclusionary in that these terms indicate the presence of a feature but not to the exclusion of any other feature.

What is claimed is:

1. A well pressure control assembly for use in working pipe in a well under pressure, comprising:

an annular pressure containment structure having a passage therethrough adapted to receive a pipe for communication through the passage into and out of the well and for rotation of the pipe about a longitudinal axis of the pipe, the annular pressure containment structure comprising a sealing wall defining at least a portion of the passage, with at least one fluid port extending through the sealing wall adjacent the passage;

wherein, when the pipe is received in the passage, hydrodynamic bearing fluid is injectable though the fluid port into the passage adjacent the pipe to maintain a pressure seal and to lubricate between the pipe and the sealing wall.

2. The well pressure control assembly of claim 1, wherein the sealing wall comprises at least a portion of a wall of a flexible bladder.

3. The well pressure control assembly of claim 2, wherein the sealing wall is constructed from a rubber material.

4. The well pressure control assembly of claim 3, wherein the rubber material is an elastomeric material.

5. The well pressure control assembly of claim 4, wherein the elastomeric material comprises neoprene.

6. The well pressure control assembly of claim 1, wherein the annular pressure containment structure comprises a pressurization cavity that is separated from the passage by the sealing wall and that is in fluid communication with the passage through the fluid port; and when the pressurization cavity is pressurized with the hydrodynamic bearing fluid, the hydrodynamic bearing fluid is injected into the passage through the fluid port.

7. The well pressure control assembly of claim 6, wherein at least a portion of the sealing wall is movable in relation to the passage in response to a change in the pressure of hydrodynamic bearing fluid within the pressurization cavity.

8. The well pressure control assembly of claim 6, wherein the sealing wall comprises at least a portion of a wall of a flexible bladder and the pressurization cavity comprises an internal volume of the bladder.

9. The well pressure control assembly of claim 8, wherein the passage has a substantially circular cross section in a plane perpendicular to the longitudinal axis of the pipe when the pipe is received in the passage; and the sealing wall and the cavity each extend circumferentially entirely around the pipe when the pipe is received in the passage.

10. The well pressure control assembly of claim 9, wherein the flexible bladder has an opening through which the hydrodynamic bearing fluid is introducible into the cavity to pressurize the cavity; and a wall of the flexible bladder defining at least a portion of the opening contacts with and seals against a pressure containment housing at least when the cavity is pressurized with the hydrodynamic bearing fluid.

11. The well pressure control assembly of claim 10, wherein adjacent the opening the wall has a tapered lip portion, the lip portion having an outer surface in indentation that indents in a direction away from the opening at least when the flexible bladder is in an unrestricted state.

12. The well pressure control assembly of claim 11, wherein the indentation is at an indentation angle of from about 2° to about 5°.

13. The well pressure control assembly of claim 10, wherein the opening is in fluid communication with a hydrodynamic bearing fluid delivery system capable of delivering the hydrodynamic bearing fluid under pressure to the pressurization cavity.

14. The well pressure control assembly of claim 13, wherein the hydrodynamic bearing fluid delivery system comprises a pump operable to pump the hydrodynamic bearing fluid to pressurize the cavity.

15. The well pressure control assembly of claim 13, wherein the source comprises a pressure accumulator in fluid communication with the opening, the pressure accumulator capable of storing the hydrodynamic bearing fluid under pressure and of delivering the hydrodynamic bearing fluid to the cavity under pressure to pressurize the cavity.

16. The well pressure control assembly of claim 1, wherein the fluid port is a first fluid port of a plurality of fluid ports extending through the sealing wall and in fluid communication with the pressurization cavity and the passage, the plurality of fluid ports being spaced circumferentially around the passage.

17. The well pressure control assembly of claim 16, wherein the sealing wall extends circumferentially entirely around the passage in a plane perpendicular to the longitudinal axis of the pipe when the pipe is received in the passage.

18. The well pressure control assembly of claim 1, wherein the passage is adapted to receive a pipe having an outside diameter of at least 2.5 centimeters.

19. The well pressure control assembly of claim 1, wherein the annular pressure containment structure extends longitudinally from a proximal end to a distal end, the distal end being disposed toward the well relative to the proximal end when the pressure containment structure is operably connected with the well; and when the pressure containment structure is operably connected with the well and the pipe is received in the passage and extends through the passage and into the well, an annular space around the outside of the pipe is located between the sealing wall and the distal end, with the annular space being in fluid communication with the well.

20. The well pressure control assembly of claim 19, wherein the annular pressure containment structure comprises a second fluid port located between the sealing wall and the distal end and through which a fluid can be introduced into or withdrawn from the pressure containment structure between the sealing wall and the distal end, whereby a fluid can be introduced into or withdrawn from the annular space when the pipe is received in the passage and extends through the passage and into the well.

21. The well pressure control assembly of claim 20, wherein the fluid containment structure comprises a valve located between the sealing wall and the second fluid port; and when the valve is in a fully closed position, the valve closes off the passage between the sealing wall and the second fluid port.

22. The well pressure control assembly of claim 20, wherein the annular pressure containment structure comprises a third fluid port located through which a fluid can be introduced into the passage between the sealing wall and the second fluid port; and when the pipe is received in the passage and extends through the passage into the well, a working fluid exiting the well can be removed from the annular space through the second fluid port and a flush fluid can be introduced into the annular space through the third port.

23. The well pressure control assembly of claim 19, wherein the sealing wall is a first sealing wall and the fluid port is a first fluid port in a first annular sealing unit and the pressure containment structure comprises a second annular sealing unit located between the first annular sealing unit and the proximal end of the pressure containment structure; and the second annular sealing unit comprises a second sealing wall defining at least a portion of the passage, with at least a second fluid port extending through the second sealing wall adjacent the passage; and when the pipe is received in the passage, the hydrodynamic bearing fluid is injectable through the second fluid port into the passage adjacent the pipe to maintain a pressure seal and lubricate between the pipe and the second sealing wall.

24. The well pressure control assembly of claim 23, wherein the annular pressure containment structure comprises a third fluid port located between the first annular sealing unit and the second annular sealing unit, whereby fluid is removable from the passage between the first annular sealing unit and the second annular sealing unit.

25. The well pressure control assembly of claim 19, wherein the annular pressure containment structure comprises a collet unit located between the sealing wall and the distal end, the collet unit including at least 3 collets capable of engaging and anchoring the pipe when the pipe is received in the passage.

26. The method of claim 25, wherein the collets are circumferentially spaced around the outside of the pipe when the pipe is received in the passage.

27. The well pressure control assembly of claim 19, wherein the pressure containment structure comprises a flange located at the distal end, the flange adapted for sealably mating with and connecting to a cooperating flange attached to a casing pipe of the well.

28. The well pressure control assembly of claim 19, comprising an automated control system, the automated control system comprising:

at least one pressure sensor capable of providing a measurement signal containing information corresponding to the pressure within the annular space; and a processing unit operationally interconnected with the pressure sensor, the processing unit capable of processing the measurement signal and responsively providing a control signal directing a change be made to the pressure of the hydrodynamic bearing fluid injected through the fluid port.

29. The well pressure control assembly of claim 28, wherein the automated control system comprises a valve actuatable responsively to the control signal to effect the change to the pressure of the hydrodynamic bearing fluid injected through the fluid port.

30. A well assembly useful for drilling or other manipulation of a well under pressure, comprising:

a casing pipe extending longitudinally at least some distance into the well and having a longitudinally extending interior space providing access into the well;

an annular pressure containment structure extending longitudinally between a proximal end and a distal end, the distal end of the annular pressure containment structure being sealably connected with the casing pipe;

a passage extending longitudinally through the interior of the pressure containment structure from the proximal end to the distal end and being in alignment with the interior space of the casing pipe, the passage being adapted to receive a working pipe for translation of the pipe into and out of the interior space of the casing pipe and for rotation of the pipe about a longitudinal axis of the working pipe, the annular pressure containment structure comprising a sealing wall defining at least a portion of the passage, with at least one fluid port extending through the sealing wall adjacent the passage;

wherein the working pipe is received in the passage and extends through the passage and at least into the interior space of the casing pipe, and hydrodynamic bearing fluid is injectable though the fluid port into the passage adjacent the working pipe to maintain a pressure seal and to lubricate between the pipe and the sealing wall.

31. The well pressure control assembly of claim 30, wherein the working pipe has a distal end located at the bottom of the well with a drill bit being attached to the distal end of the working pipe and being in contact with a distal end of the well, and the pipe is rotatable simultaneous with injection of the hydrodynamic bearing fluid through the fluid port, thereby maintaining the seal and the lubrication during drilling of the well.

32. The well pressure control assembly of claim 31, wherein the pipe is simultaneously rotatable and longitudinally translatable while the hydrodynamic bearing fluid is injected through the fluid port, thereby permitting the pipe to move deeper into the well under pressure as the well is deepened during the drilling.

33. The well pressure control assembly of claim 31 comprising:

a fluid delivery system in fluid communication with an interior flow conduit within the working pipe, the fluid delivery system capable of delivering a flow of a working fluid through the working pipe to establish circulation of the working fluid through the interior flow conduit of the working pipe, out a distal end of the working pipe disposed in the well, through an annular space in the well about the outside of the working pipe and into the passage of the annular pressure containment structure.

34. The well pressure control assembly of claim 33, wherein the annular pressure containment structure comprises a second fluid port located between the sealing wall and the well through which at least a portion of the working fluid is removed from the passage.

35. The assembly of claim 34, wherein when the hydrodynamic bearing fluid is injected into the passage through the fluid port, at least a portion of the hydrodynamic bearing fluid is removable from the passage through the second fluid port along with removal of at least a portion of the working fluid.

36. The well pressure control assembly of claim 30, wherein the pipe comprises a plurality of pipe pieces connected into a string of pipe with flush joint connections between the pipe pieces.

37. A method of manipulating a pipe in a well, the method comprising:

disposing a distal end of the pipe in a well with a proximal end of the pipe remaining outside of the well, with at least a portion of the pipe between the distal end of the pipe and the proximal end of the pipe passing through a sealing portion of a passage extending through the interior of an annular pressure containment structure operably connected with the well, the annular pressure containment structure having a distal end located toward the well and a proximal end located away from the well, with the passage extending in a direction from the proximal end of the annular pressure containment structure to the distal end of the annular pressure containment structure and the passage being aligned with the well for movement of the pipe through the passage into and out of the well;

the annular pressure containment structure comprising a sealing wall defining at least a portion of the sealing portion of the passage, with at least one fluid port extending through the sealing wall adjacent the first passage;

moving the distal end of the pipe in the well, the moving comprising at least one of translating the pipe through the sealing portion of the passage and rotating the pipe within the sealing portion of the passage;

during the moving, injecting a hydrodynamic bearing fluid through the fluid port into the sealing portion of the passage adjacent an exterior surface of the pipe, thereby lubricating between the sealing wall and the pipe during the moving.

38. The method of claim 37, comprising circulating a working fluid through the well simultaneously with injecting, the circulating comprising flowing the working fluid through an interior flow conduit in the pipe from the proximal end of the pipe to the distal end of the pipe, out of the distal end of the pipe disposed in the well, out of the well through a first annular space in the well around the outside of the pipe and into a second annular space in the passage of the annular pressure containment structure around the outside of the pipe, the second annular space being located between the sealing portion of the passage and the distal end of the pressure containment structure.

39. The method of claim 38, wherein a bit is connected to the distal end of pipe and during the circulating the working fluid flowing through the bit prior to flowing out of the well.

40. The method of claim 38, wherein during the circulating at least a portion of the hydrodynamic bearing fluid injected into the passage flows into the second annular space and mixes with the working fluid.

41. The method of claim 40, wherein during the circulating at least a portion of a mixture of the working fluid and the hydrodynamic bearing fluid is removed from the second annular space through a second fluid port of the annular pressure containment structure in fluid communication with the second annular space and located between the sealing portion of the passage and the distal end of the annular pressure containment structure.

42. The method of claim 41, wherein a drill bit is attached to the distal end of the pipe and the moving comprises rotating the pipe to rotate the drill bit, with the drill bit in contact with a distal end of the well thereby drilling the well to a deeper depth.

43. The method of claim 41, wherein during the rotating, drill cuttings are dislodged from the distal end of the well and at least a portion of the drill cuttings are removed from the second annular space through the second fluid port along with the mixture of the working fluid and the hydrodynamic bearing fluid.

44. The method of claim 41, wherein the working fluid and the hydrodynamic bearing fluid are each an aqueous liquid.

45. The method of claim 37, wherein the sealing portion of the passage is a first sealing portion of the passage located within a first pressure sealing unit of the annular pressure containment structure, and the sealing wall is a first sealing wall, the fluid port is a first fluid port and the hydrodynamic bearing fluid is a first portion of hydrodynamic bearing fluid; and the annular pressure containment structure comprises a second pressure sealing unit, the second pressure sealing unit comprising a second sealing portion of the passage and a second sealing wall defining at least a portion of the second sealing portion of the passage, with at least a second fluid port extending through the second sealing wall adjacent the passage; and during the moving, at least a portion of the pipe is disposed in the second sealing portion of the passage and a second portion of hydrodynamic bearing fluid is injected through the second fluid port into the second sealing portion of the passage adjacent an exterior surface of the pipe, thereby lubricating between the second sealing wall and the pipe during the moving.

46. The method of claim 45 wherein during the moving at least a portion of the second portion of hydrodynamic bearing fluid flows into a space in the passage located between the first pressure sealing unit and the second pressure sealing unit and is removed from the space through a third fluid port of the annular pressure containment structure in fluid communication with the space and located between the first sealing portion and the second sealing portion.

47. The method of claim 37 wherein the well extends away from the annular pressure containment structure in a direction extending in an upward direction and the moving comprises translation of the distal end of the pipe in an upward direction deeper into the well.

48. The method of claim 37, comprising:

monitoring pressure within the second annular space; and generating a pressure signal containing information corresponding to pressure within the second annular space;

processing the pressure signal and generating a control signal containing data corresponding to a change to be made in the pressure of the hydrodynamic bearing fluid being injected through the fluid port; and responsive to the control signal, automatically changing the pressure at which the hydrodynamic bearing fluid is injected through the fluid port.

* * * * *

UNITED STATES PATENT AND TRADEMARK OFFICE

CERTIFICATE OF CORRECTION

PATENT NO. : 6,796,381 B2
DATED : September 28, 2004
INVENTOR(S) : Ayler et al.

It is certified that error appears in the above-identified patent and that said Letters Patent is hereby corrected as shown below:

Column 2,
Line 41, delete “though” and insert therefor -- through --.

Column 8,
Line 2, delete “though” and insert therefor -- through --.

Column 14,
Line 26, delete “cemtimeters” and insert therefor -- centimeters --.

Column 22,
Line 50, delete “though”, and insert therefor -- through --.

Column 25,
Line 47, delete “though” and insert therefor -- through --.

Signed and Sealed this

Third Day of May, 2005

JON W. DUDAS
*Director of the United States Patent and Trademark Office*